US007315711B2

(12) United States Patent
Ariizumi et al.

(10) Patent No.: US 7,315,711 B2
(45) Date of Patent: Jan. 1, 2008

(54) IMAGE FORMING APPARATUS, PROCESS CARTRIDGE AND CLEANINGLESS SYSTEM

(75) Inventors: Osamu Ariizumi, Kanagawa (JP); Masahide Yamashita, Tokyo (JP); Koji Suzuki, Kanagwa (JP); Yasushi Koichi, Kanagawa (JP); Shigekazu Enoki, Kanagawa (JP); Kumiko Hatakeyama, Kanagawa (JP); Koichi Kato, Kanagawa (JP); Toshiyuki Kabata, Kanagawa (JP); Jun Yura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 249 days.

(21) Appl. No.: 11/150,299

(22) Filed: Jun. 13, 2005

(65) Prior Publication Data

US 2005/0276632 A1 Dec. 15, 2005

(30) Foreign Application Priority Data

Jun. 14, 2004 (JP) ..... 2004-176285

(51) Int. Cl.
*G03G 15/24* (2006.01)
*G03G 15/09* (2006.01)

(52) U.S. Cl. ..... 399/149; 399/270; 399/277

(58) Field of Classification Search ..... 399/148–150, 399/267, 270, 277
See application file for complete search history.

(56) References Cited

U.S. PATENT DOCUMENTS

| | | | | |
|---|---|---|---|---|
| 5,717,983 | A * | 2/1998 | Ochiai et al. | 399/150 |
| 5,870,656 | A * | 2/1999 | Hibino et al. | 399/149 |
| 6,505,022 | B2 | 1/2003 | Kosuge et al. | |
| 6,653,037 | B2 | 11/2003 | Sawada et al. | |
| 6,701,114 | B2 | 3/2004 | Sekine et al. | |
| 6,873,814 | B2 | 3/2005 | Ohjimi et al. | |
| 6,898,406 | B2 | 5/2005 | Suzuki et al. | |
| 7,031,629 | B2 * | 4/2006 | Kawamura et al. | 399/149 |
| 7,167,665 | B2 * | 1/2007 | Tomita et al. | 399/149 |

FOREIGN PATENT DOCUMENTS

JP 3091323 7/2000

* cited by examiner

*Primary Examiner*—William J. Royer
(74) *Attorney, Agent, or Firm*—Oblon, Spivak, McClelland, Maier & Neustadt, P.C.

(57) ABSTRACT

An image forming apparatus of includes a developing device bifunctioning as a cleaning device for collecting toner grains left on a photoconductive drum after the transfer of a toner image from the drum to a paper sheet or similar image transfer medium. In the event of toner collection, a DC voltage is applied that causes the residual toner to move from the drum toward a developing sleeve. A main-pole magnet generates, at a position where the developing sleeve faces the drum, a magnetic field of between 100 mT and 200 mT in a direction normal to the surface of the sleeve.

53 Claims, 16 Drawing Sheets

FIG. 17

| MAGNETIC FORCE [ mT ] | 70 | 85 | 95 | 100 | 112 |
|---|---|---|---|---|---|
| COLLECTION RATIO [ % ] | 92 | 93 | 94 | 95 | 95 |

FIG. 18

| MAGNETIC FORCE [ mT ] | 160 | 180 | 200 | 220 |
|---|---|---|---|---|
| IMAGE WITH BRUSH MARKS | NOT APPEARED | NOT APPEARED | NOT APPEARED | APPEARED |

FIG. 19

| MAIN-POLE ANGLE [° ] | 0 | 2 | 3 | 6 | 8 |
|---|---|---|---|---|---|
| COLLECTION RATIO [ % ] | 80 | 85 | 90 | 95 | 60 |

FIG. 20

| VOLTAGE [ V ] | −100 | −200 | −300 | −400 | −500 |
|---|---|---|---|---|---|
| COLLECTION RATIO [ % ] | 92 | 94 | 95 | 97 | 97 |

IMAGE FORMING APPARATUS, PROCESS CARTRIDGE AND CLEANINGLESS SYSTEM

BACKGROUND OF THE INVENTION

1. Field of the Invention

The present invention relates to a copier, printer, facsimile apparatus or similar image forming apparatus, a process cartridge and a cleaningless system.

2. Description of the Background Art

One type of conventional image forming apparatuses is configured to form an electric field for image transfer between a photoconductive element and an image transfer medium moving in contact with the photoconductive element to thereby transfer a toner image from the photoconductive element to the image transfer medium. In such an electrostatic image transfer type of image forming apparatus, residual toner is often left on the surface of the photoconductive element after the transfer of the toner image. Should the surface portion of the photoconductive element where the residual toner exists be subject to the next image forming cycle, irregular charging or similar defective charging would occur at the above surface portion, degrading image quality. To solve this problem, it has been customary to remove the residual toner with a cleaning device located at a position where it faces the photoconductive element between an image transferring zone and a charging zone.

However, the problem with the cleaning device described above is that it needs spaces for accommodating a waste toner tank for storing the residual toner collected from the photoconductive element, a conduit for reusing the collected toner and so forth, increasing the overall size of the image forming apparatus. This is particularly true with a tandem image forming apparatus in which the cleaning device must be assigned to each of a plurality of photoconductive elements.

In light of the above, Japanese Patent No. 3091323, for example, discloses an image forming apparatus of the type causing a developing device to collect residual toner from the surface of a photoconductive element. This type of toner collecting system causes the developing device to play the role of cleaning device at the same time and therefore does not need a cleaning device independent of the developing device. Further, spaces for accommodating the conduit for the conveyance of the collected residual toner and so forth are not necessary. Therefore, this type of toner collecting system contributes a great deal to the size reduction of an image forming apparatus.

Recently, however, the diameter of a developing roller and that of a photoconductive element are decreasing in parallel with the size reduction of an image forming apparatus. This brings about a problem that a developing zone where the photoconductive element and developing roller are closest to each other is narrowed and lowers the collection ratio of the residual toner from the photoconductive element. Consequently, the residual toner not collected accumulates on the photoconductive element, resulting in background contamination and other image defects and toner scattering and other mechanical troubles.

SUMMARY OF THE INVENTION

It is an object of the present invention to provide an image forming apparatus of the type collecting residual toner with a developing device and capable of collecting residual toner more efficiency than a conventional image forming apparatus of the type described, and a process cartridge removably mounted to the image forming apparatus.

An image forming apparatus of the present invention includes an image carrier. After a charging device has uniformly charged the surface of the image carrier, a latent image forming device forms a latent image on the surface of the image carrier uniformly charged by the charging device. Subsequently, a developing device develops the latent image to thereby produce a corresponding toner image. The developing device includes a stationary magnetic field generating member disposed thereinside and rotatable with a two-ingredient type developer made up of magnetic carrier grains and toner grains deposited on the surface thereof. An image transferring device transfers the toner image from the image carrier to an image transfer medium. The developing device bifunctions as a cleaning device for collecting residual toner grains left on the image carrier after the transfer of the toner image to the image transfer medium. In the event of collection of the residual toner grains, a DC voltage is applied to the image carrier and developer carrier to thereby form an electric field in a direction in which the residual toner grains move from the image carrier toward the developer carrier. The magnetic field generating device generates, at a position where the developer carrier faces the image carrier, a magnetic field whose magnetic force in a direction normal to the surface of the developer carrier is between 100 mT and 200 mT.

A process cartridge removably mounted to the image forming apparatus having the above configuration is also disclosed.

BRIEF DESCRIPTION OF THE DRAWINGS

The above and other objects, features and advantages of the present invention will become more apparent from the following detailed description taken with the accompanying drawings in which:

FIG. 17 is a table listing the result of Experiment 1;

FIG. 18 is a table listing the result of Experiment 2;

FIG. 19 is a table listing the result of Experiment 5; and

FIG. 20 is a table listing the result of Experiment 6.

DESCRIPTION OF THE PREFERRED EMBODIMENTS

Preferred embodiments of the present invention will be described hereinafter with reference to the accompanying drawings.

First Embodiment

Figure 1:
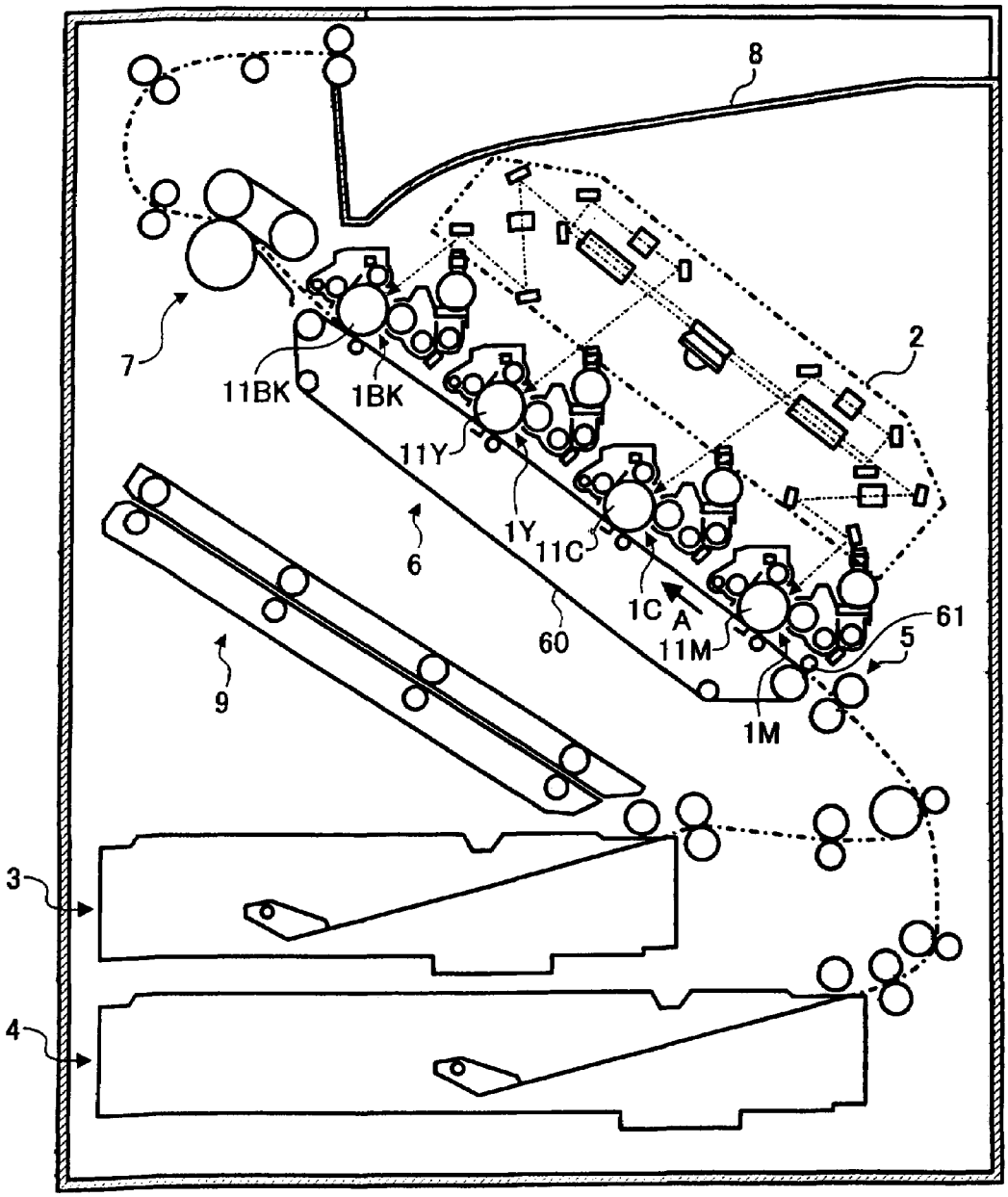
FIG. 1 shows the general construction of an image forming apparatus embodying the present invention.
Figure 2:
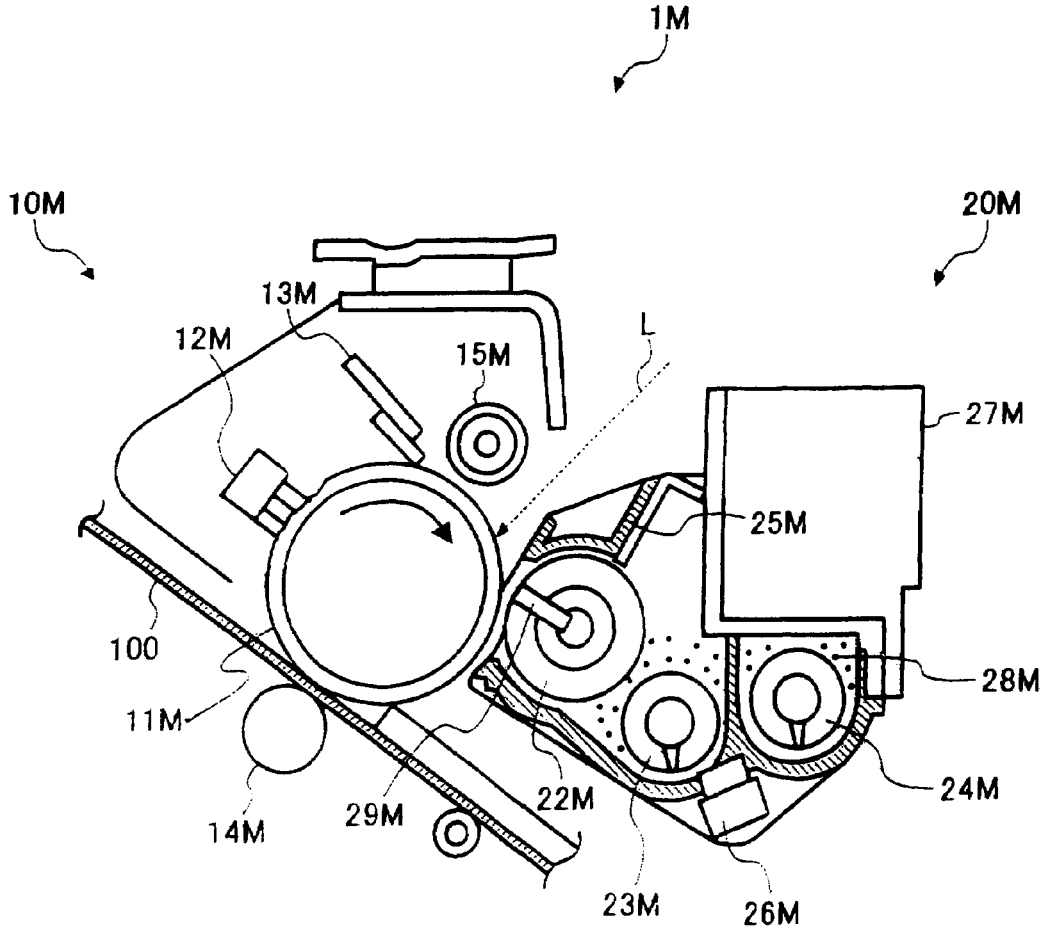
FIG. 2 is an enlarged view showing one of a plurality of image forming means included in the illustrative embodiment.

Referring to FIG. 1 of the drawings, an image forming apparatus embodying the present invention is shown and implemented as an electrophotographic color laser printer by way of example. As shown, the electrophotographic color laser printer (simply printer hereinafter) includes four image forming means 1M (magenta), 1C (cyan), 1Y (yellow) and 1BK (black) for forming toner images of respective colors. It is to be noted that members included in the image forming means 1M, 1C, 1Y and 1BK are distinguished from each other by suffixes M, C, Y and BK also. The image forming means 1M through 1BK are sequentially positioned from the upstream side toward the downstream side in a direction indicated by an arrow A in which a paper sheet or image transfer medium 100, see FIG. 2, is conveyed.

The image forming means 1M, 1C, 1Y, and 1BK respectively include image carrier units, which respectively include photoconductive drums or image carriers 11M, 11C, 11Y, and 11BK, and respective developing units. The image forming means 1M, 1C, 1Y, and 1BK are arranged such that the axes of the photoconductive drums (simply drums hereinafter) 11M, 11C, 11Y, and 11BK extend horizontally and at a preselected pitch in the direction A.

The printer further includes an optical writing unit or latent image forming means 2 and sheet cassettes 3 and 4. An image transferring unit 6 includes an endless belt or image transfer belt 60 for conveying the paper sheet 100 via consecutive image transfer stations where the belt 60 faces the drums 1M, 11C, 1Y, and 11BK. A pair of registration rollers 5 cooperate to stop the paper sheet 100 and then drive the paper sheet 100 toward the belt 60 at preselected timing. A fixing unit 7, including a fixing belt, a print tray 8, and a turning unit 9 are arranged downstream of the belt 60 in the direction A. Further, the illustrative embodiment includes a manual feed tray, toner containers, waste toner bottles, and a power supply unit, although not shown specifically.

The optical writing unit 2 includes lasers or light sources, polygonal mirrors, f-E lenses, and mirrors, as illustrated. The optical writing unit 2 scans the surfaces of the drums 11M, 11C, 11Y, and 11BK with laser beams in accordance with image data of respective colors.

In FIG. 1, a dash-and-dot line is representative of a path along which the paper sheet 100 is conveyed. More specifically, the paper sheet 100 paid out from the sheet cassette 3 or 4 is conveyed by roller pairs to the registration roller 5 to a temporary stop position 5 while being guided by guides not shown. The registration roller pair once stops the paper sheet 100 and then drives it toward the belt 60 at preselected timing. The belt 60, receives the paper sheet 100, conveys the paper sheet 100 via the consecutive image transfer positions where the belt 60 faces the drums 11M, 11C, 11Y, and 11BK. As a result, toner images formed on the drums 11M, 11C, 11Y, and 11BK by the image forming means 1M, 1C, 1Y, and 1BK, respectively, are sequentially transferred to the paper sheet 100 one above the other, completing a full-color image on the paper sheet 100. The paper sheet 100, carrying the full-color image thereon, is conveyed to the fixing unit 7 to have the image fixed thereby. The paper sheet or print 100, coming out of the fixing unit 7, is driven out to the print tray 8.

The image forming means 1M, 1C, 1Y, and 1BK are identical in configuration with each other except for the color of toner to use. Therefore, the following description will concentrate on the magenta image forming means 1M by way of example.

As shown in FIG. 2, the image forming means 1M includes an image carrier unit 10M and a developing unit 20M. The image carrier unit 10M includes, in addition to the drum 11M, a non-contact type charge roller 15M for uniformly charging the surface of the drum 11M. A blade or toner holding member 13M is held in contact with part of the surface of the drum 11M in order to temporarily hold residual toner left thereon after image transfer. The blade 13M is held in contact with the drum 11M during image formation in order to prevent the residual toner from passing it, thereby preventing the residual toner from remaining in the latent image forming zone of the drum 11M in the event of formation of a latent image. In the event of collection of the residual toner, the blade 13M is released from the surface of the drum 11M for thereby allowing the residual toner from being conveyed to the downstream side in the direction of rotation of the drum 11M. A charge brush or auxiliary charging means 12M charges toner grains of an opposite polarity opposite to an expected polarity and included in the residual toner left on the drum 11M to an expected polarity. A power supply, not shown, is connected to the charge brush 12M for applying a bias thereto.

In the image carrier unit 10M with the above configuration, the charge roller 15M, applied with a preselected voltage, uniformly charges the surface of the drum 11M. More specifically, a DC voltage of −600 V is applied to the core of the charge roller 15M for thereby uniformly charging the surface of the drum 11M to −400 V. The optical writing unit 2 scans the thus charged surface of the drum 11M with a laser beam L modulated in accordance with image data to thereby form a latent image on the drum 11M. Subsequently, the developing unit or developing means 20M, which will be described more specifically later, develops the latent image on the drum 11M for thereby producing a magenta toner image. The magenta toner image is transferred from the drum 11M to the paper sheet 100, which is being conveyed by the belt 60, at an image transfer position by a primary image transfer roller or image transferring means 14M.

The developing unit 20M stores a two-ingredient type developer made up of magnetic carrier grains and toner grains charged to negative polarity as a developer 28M for developing the latent image formed on the drum 11M. The toner grains may be implemented by pulverized toner grains, polymerized toner grains or similar conventional toner grains. A sleeve or developer carrier 22M, formed of a nonmagnetic material, is disposed in a casing while being partly exposed to the outside via an opening formed in the casing and adjoining the drum 11M. A magnet roller or magnetic field forming means, not shown, is disposed inside the sleeve 22M. The developing unit 20M further includes screws 23M and 24M for conveying the developer 28M, a doctor or metering member 25M, a permeability sensor 26M responsive to the permeability of the developer 28M, and a developer cartridge 27M. Labeled 29M is a main-pole magnet included in the magnet roller as magnetic field forming means that forms a magnetic brush in a developing zone. During image formation, a negative DC voltage or DC component is applied from a bias power supply or development electric field forming means, not shown, to the sleeve 22M, biasing the sleeve 22M to a preselected voltage relative to a metallic base layer included in the drum 11M.

In FIG. 2, the developer 28M stored in the casing is sequentially conveyed by the screws 23M and 24M while being charged by friction. Subsequently, part of the developer 28M is deposited on the surface of the sleeve 22M and conveyed thereby to a developing position where the sleeve 22M faces the drum 11M while being regulated in thickness, or metered, by the doctor 25M. At the developing position, the charged toner grains contained in the developer 28M are transferred from the sleeve 22M to a latent image formed on the drum 11M to thereby produce a corresponding toner image.

The toner content of the developer 28M stored in the casing and decreases due to repeated image formation is determined on the basis of the area of an image and the output of the permeability sensor 26M. Fresh toner grains are replenished from the developer cartridge 27M to the casing in accordance with the output (Vt) of the permeability sensor 26M, maintaining the toner content of the developer 28M substantially constant. More specifically, assume that the target toner content of the developer 28M is Vref. Then, if a difference $\Delta T(=Vref-Vt)$ is positive, then the toner content is determined to be sufficiently high and does not need replenishment. If the difference $\Delta T$ is negative, then fresh toner grains are replenished in an amount proportional to $|\Delta T|$ so as to bring Vt closer to Vref. Also, process control is executed once for ten paper sheets (ranging from about five to 200 paper sheets) in order to set Vref, charge potential and quantity of light. The process control may be implemented as a mode in which the amounts of toner deposited on a plurality of halftone and solid patterns formed on the drum 11M are sensed in order to set up a target amount of deposition. A controller, not shown, executes such toner content control with a CPU (Central Processing Unit), a ROM (Read Only Memory), a RAM (Random Access Memory) or storing means, and an I/O (Input/Output Interface).

In the illustrative embodiment, only the drum 11BK positioned at the most downstream side is constantly held in contact with the belt 60 while the other drums 11M, 1C and 11Y are movable into or out of contact with the belt 60, as needed.

The image forming means 1M, 1C, 1Y, and 1BK each are constructed into a process cartridge removable from the apparatus body along guide members not shown. For example, the image carrier unit 10M and developing unit 20M are constructed into a single image forming means (process cartridge) 1M. When some member included in the process cartridge 1M must be replaced, the process cartridge 1M should only be bodily removed from the apparatus body, implementing easy replacement. Alternatively, considering a life particular to each member, only the image carrier unit 10M may be implemented as a process cartridge, in which case the developing unit 20M and image carrier unit 10M will be configured to be removable from the apparatus body independently of each other.

Referring again to FIG. 1, a full-color image forming mode available with the illustrative embodiment will be described hereinafter. In this mode, all of the four drums 11M, 11C, 11Y, and 11BK are held in contact with the belt 60. An electrostatic adhesion roller 61 applies a charge of the same polarity as the toner to the paper sheet 100 to thereby cause the paper sheet 100 to electrostatically adhere to the belt 60, so that toner images are protected from defective transfer ascribable to the charge-up of the paper sheet 100.

While the belt 60 conveys the paper sheet 100 electrostatically adhering thereto, a magenta, a cyan, a yellow and a black toner image respectively formed on the drums 11M, 11C, 11Y, and 11BK are sequentially transferred to the paper sheet 100 one above the other, completing a full-color image on the paper sheet 100. The full-color toner image thus formed on the paper sheet 100 is then fixed by the fixing unit 7.

On the other hand, in a monochromatic image forming mode, i.e., a black image forming mode also available with the illustrative embodiment, the drums 11Y, 11C and 11M are released from the belt 60 while the BK drum 11BK is held in contact with the belt 60 alone. In this condition, a black toner image formed on the BK drum 11BK is transferred to the sheet 100 brought to a nip between the drum 11BK and the belt 60. The black toner image is fixed on the paper sheet 100 in the same manner as the full-color toner image.

Hereinafter will be described cleaning of the drum 11M, i.e. removal of residual toner grains left on the drum 11M after image transfer.

Figure 3A:
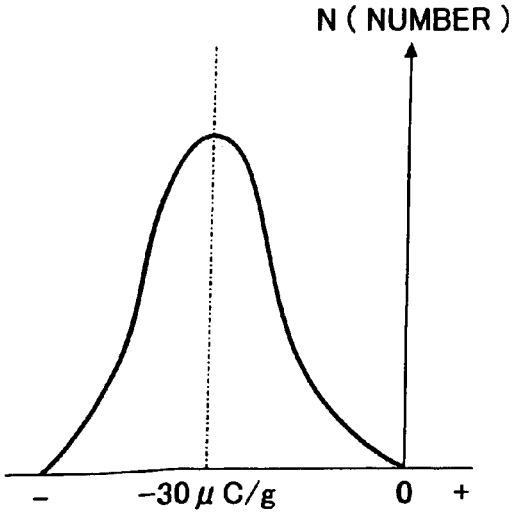
FIG. 3A is a graph showing the charge potential distribution of toner deposited on a photoconductive drum, as measured just before transfer.
Figure 3B:
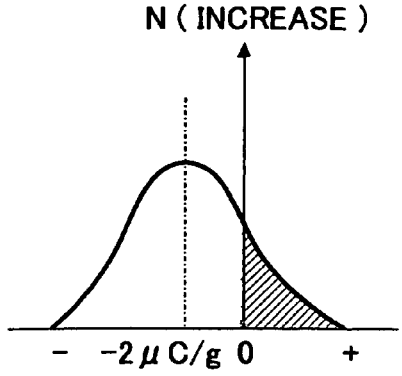
FIG. 3B is a graph showing the charge potential distribution of residual toner left on the drum after image transfer.

FIG. 3A shows a curve representative of the charge distribution of toner grains on the drum 11M, as measured just before the transfer of a toner image. FIG. 3B shows a curve representative of the charge distribution of residual toner grains remaining on the drum 11M after image transfer. As FIG. 3A indicates, the amount of charge of toner grains just before image transfer is distributed mainly around −30 μC/g and mostly to negative polarity, which is the expected polarity. By contrast, as shown in FIG. 3B, the amount of charge of residual toner grains substantially centers around −2 μC/g. Generally, most residual toner grains are of a polarity opposite to an expected one due to, e.g., charge injection by a positive bias applied to the primary image transfer roller 14. This is why toner grains inverted in polarity are contained in the residual toner grains, as indicated by hatching in FIG. 3B. In the event of collection of residual toner grains, the toner grains of opposite polarity pass through the developing zone without being collected by the developing unit 20M. It is therefore necessary to again charge the residual toner grains to the original polarity, i.e., negative polarity before collection.

The residual toner grains, containing the toner grains of opposite or positive polarity, deposit on the surface of the drum 11M and then pass the charge brush 12M. A negative bias is applied from a power supply, not shown, to the charge brush 12M, inverting the polarity of the toner grains of a positive polarity deposited on the drum 11M to a negative polarity. Consequently, the residual toner grains on the drum 11M passing the charge brush 12M are uniformly charged to a negative polarity. The bias applied to the charge brush 12M is sufficient to invert the polarity of the toner grains to the polarity of the bias on the basis of a difference in potential between the bias and the surface of the drum 11M.

The toner grains present on the drum 11M and passing the charge brush 12M are held by the blade 13M for a moment. The blade 13M is movable into or out of contact with the drum 11M and is released from the drum 11M at preselected timing. More specifically, the blade 13M is positioned upstream of the charge roller 15M in the direction of rotation of the drum 11M. If desired, the blade 13M, capable of temporarily holding the residual toner grains, may be positioned between the charge roller 15M and the latent image forming zone so as to prevent the residual toner grains from passing through the latent image forming zone during the formation of a latent image. This prevents, in an image forming apparatus of development and cleaning type, toner grains from depositing on a drum during latent image formation and obstructing faithful formation of a latent image. Particularly, in a configuration in which the dot size of a latent image is decreasing for higher image quality and image quality is highly susceptible to toner present in an exposing portion, there can be obviated spot-like omission of an image.

Figure 4:
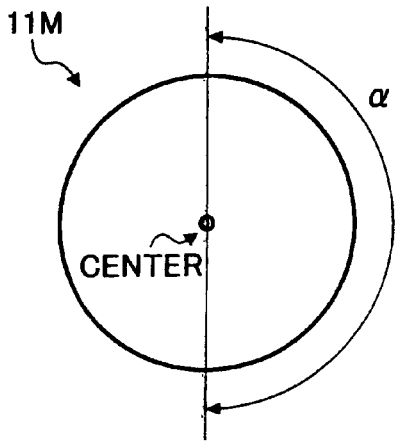
FIG. 4 is a view for describing the position of a blade.

Further, the blade 13M is located at a position where the toner grains held thereby do not drop due to their own weight. More specifically, as shown in FIG. 4, the blade 13M is so positioned as to contact the surface of the drum 11M in a zone $\alpha$ in which the surface of the drum 11M in the vertical direction decreases due to movement. Further, the blade 13M is held in contact with the drum 11M in such a position as to be capable of holding the residual toner grains scraped off from the drum 11M between the surface of the drum 11M and the side of the blade 13M. Assume that the blade 13M is positioned in the lower half of the circle shown in FIG. 4 although it belongs to the zone $\alpha$. Then, the blade 13M should not be configured to hold a great amount of toner grains because such an amount of toner grains are apt to drop before the blade 13M is released from the drum 11M.

However, if the blade 13M is positioned between the charge roller 15M and the latent image forming zone, then the distance the surface of the drum 11M moves from the charging position to the developing position increases. This is apt to cause the potential on the surface of the drum 11M to vary in accordance with the above distance and lower image quality. Furthermore, if the blade 13M is located downstream of the charge roller 15M in the direction of rotation of the drum 11M, then it is likely that the residual toner grains exist on the drum 11M at the time of charging and hide part of the drum surface to thereby obstruct uniform charging.

As shown in FIG. 2, by positioning the blade 13M upstream of the charge roller 15M in the direction of rotation of the drum 11M, it is possible to minimize the distance the drum 11M moves from the charging position to the developing position. Also, it is possible to reduce the variation of potential on the drum 11M. Moreover, the charge roller 15M can uniformly charge the drum 11M because toner grains are absent on the drum 11M at the time of charging.

When the residual toner grains held by the blade 13M contain both of grains of expected polarity and grains of opposite polarity, the two kinds of grains are likely to be electrostatically connected while being held by the blade 13M. If such residual toner grains are again returned to the surface of the drum 11M at preselected timing, then the residual toner grains are apt to fail to pass through the gap between the charge roller 15M and the drum 11M, resulting in defective charging and therefore low image quality. In accordance with the present invention, the residual toner grains are uniformly charged to a negative polarity by the charge brush 12M before being temporarily held by the blade 13M and therefore prevented from being connected together while being held by the blade 13M. It follows that the toner grains returned from the blade 13M to the surface of the drum 11M smoothly pass through the gap between the drum 11M and the charge roller 15M, obviating defective charging and other defects.

Figure 5:
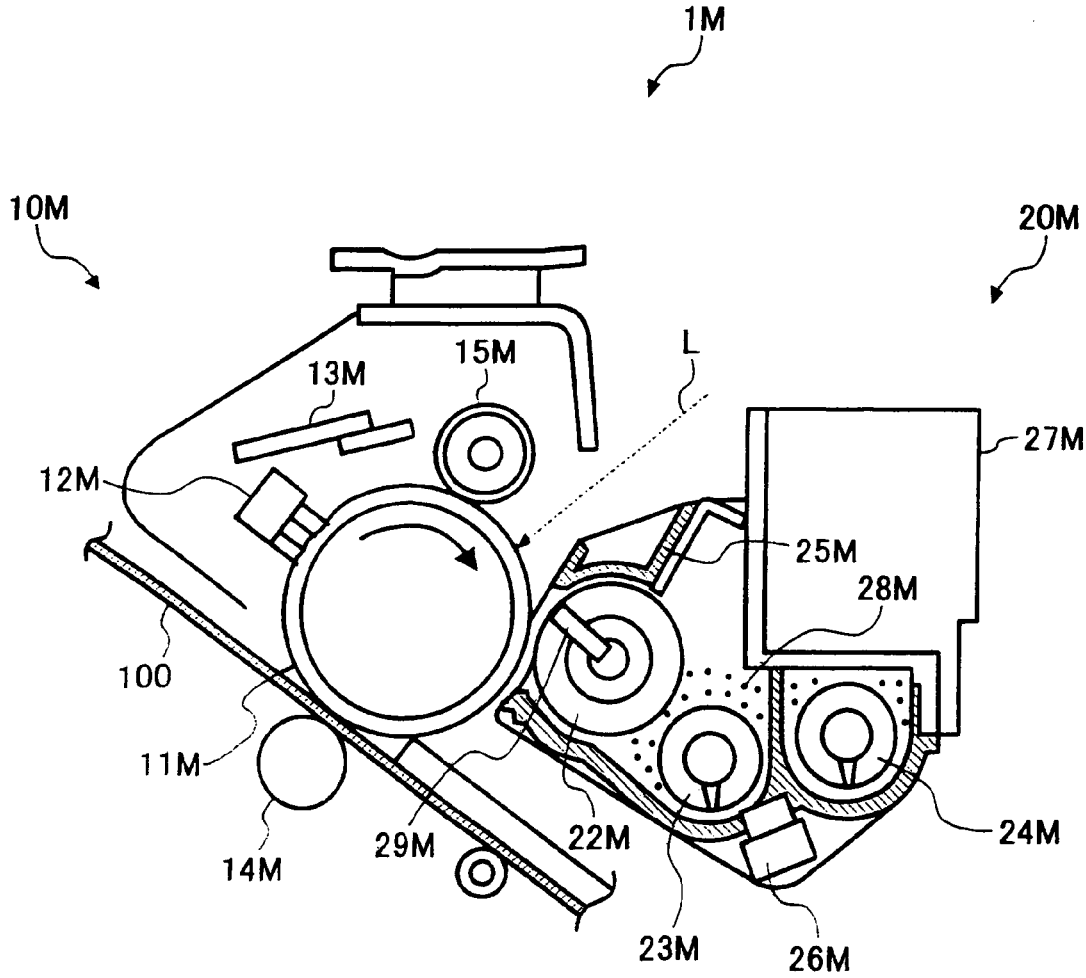
FIG. 5 is an enlarged view showing the image forming means operating in a cleaning mode available with the illustrative embodiment.

FIG. 5 shows the image forming means 1M in a condition wherein residual toner grains are collected. As shown, the blade or toner holding member 13M is released from the drum or image carrier 11M. More specifically, the blade 13M is released from the drum 11M at such timing that a latent image is not formed when the residual toner grains returned to the drum 11M pass through the latent image forming zone. As soon as the blade 13M is released from the drum 11M, the residual toner grains stopped by the blade 13M are allowed to move together with the surface of the drum 11M. For example, the blade 13M may be released from the drum 11M in a cleaning mode, or toner collection mode, provided at the start-up of the apparatus, after image formation or after an image forming cycle has been repeated a preselected number of times. If desired, the cleaning mode may be provided between consecutive image forming steps also, releasing the blade 13M from the drum 11M to thereby return the residual toner grains to the drum 11M.

Figure 6:
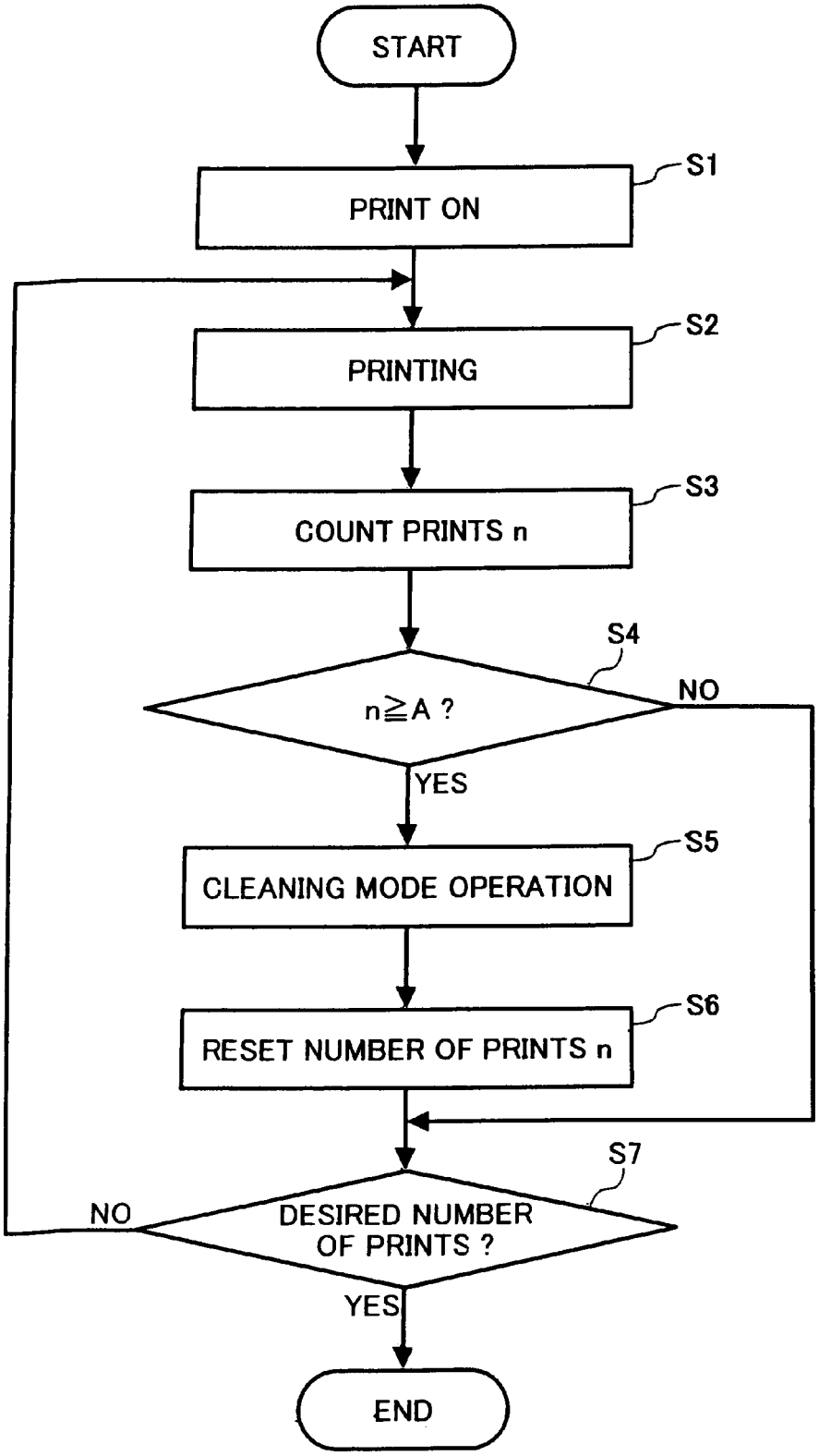
FIG. 6 is a flowchart demonstrating specific timing at which the blade is brought into or out of contact with the drum.

FIG. 6 is a flowchart demonstrating a specific procedure in which the blade 13M is brought into and out of contact with the drum 11M on the assumption that a cleaning mode operation is effected after an image forming cycle has been repeated a preselected number of times. As shown, after the operator of the apparatus has input a desired number of prints and then turned on a print switch, not shown, (step S1), the apparatus performs a printing operation (step S2) while counting the number of prints n (S3). When the number of prints n reaches or exceeds a preselected number A (Yes, step S4), the cleaning mode operation is executed (step S5). In the cleaning mode, the blade 13M is released from the drum 11M to return residual toner grains to the drum 11M. At the same time, the bias applied to the sleeve 22M for development is switched from negative to positive. The drum 11M is then rotated to cause the residual toner grains deposited thereon to be collected by the developing device 20M.

When the drum 11M is rotated a preselected number of times (more than one time inclusive), the cleaning mode is ended. Then, the number of prints n is reset (step S6). On the other hand, when the desired number of prints are output (Yes, step S7), the printing operation is ended. If the number of prints output is short of the desired number (No, step S7), then the procedure returns to the step S2. If the number prints output is short of the preselected number A (No, step S4) and short of the desired number (No, step S7), then the procedure also returns to the step S2. If the answer of the step S7 is Yes, then the printing operation is ended.

The residual toner grains returned from the blade 13M to the drum 11M at the timing stated above are uniformly charged to the expected polarity by the charge brush 12M and therefore pass the charge roller 15M without electostatically depositing thereon. Such toner are then conveyed via the latent image forming zone to the developing zone where the drum 11M faces the sleeve 22M when a latent image is not being formed.

How the developing device 20M collects the residual toner conveyed thereto by the drum 11M will be described hereinafter. A bias opposite in polarity to the bias for development, i.e., a positive bias is applied to the sleeve 22M. Because the residual toner grains conveyed to the developing zone by the drum 11M, as stated above, have been entirely charged to a negative polarity by the charge brush 12M, they electrostatically adhere to the carrier grains present on the sleeve 22M, which is biased to a positive polarity. As a result, the residual toner grains deposited on the carrier grains are collected in the developing device 20M by the sleeve 22M.

The main-pole magnet 29M included in the magnet roller, not shown, is positioned at the developing zone where the sleeve 22M and drum 11M are closest to each other and generates a magnetic force of between 100 mT and 200 mT as measured in the direction normal to the surface of the sleeve 22M. The main-pole magnet 29M promotes the collection of the residual toner grains in the developing device 20M.

More specifically, the magnetic force as strong as 100 mT or above in the direction normal to the surface of the sleeve 22M strengthens the force with which the sleeve 22M attracts a magnetic brush formed thereon by the magnetic carrier grains of the developer 28M, increasing the density of the magnetic brush. At this instant, voids in the magnetic brush and therefore the electric resistance of the magnetic brush decreases, so that the toner grains in the developing zone can faithfully move in an electric field formed between the sleeve 22M and the drum 11M. This is also true when the residual toner is collected. Further, the strong magnetic force of the sleeve 22M makes the magnetic brush hard for thereby increasing the force with which the magnetic brush rubs the drum 11M, so that the residual toner can be collected more effectively in the developing device 20M.

However, if the rubbing force of the magnetic brush is excessively strong, then it scrapes off a toner image during development and renders the resulting image defective due to fine white stripes, or voids, ascribable to the magnetic brush. To obviate this image defect, it is necessary to make the magnetic force in the normal direction 200 mT or below. Further, the bias for development and toner collection should preferably be a DC voltage because an AC voltage would cause the toner to again deposit on the drum 11M.

The following experiments were conducted to estimate the collection of the residual toner grains by varying the magnetic force of the main-pole magnet 29M.

EXPERIMENT 1

Experiment 1 was conducted under the following conditions:

drum surface speed: 250 mm/sec
drum diameter: 30 mm
sleeve surface speed: 500 mm/sec
developing roller diameter: 18 mm
carrier grain size: 35 μm
toner grain size: 6 μm
magnetic force of magnet: 70-112 mT
bias for development: −300 V
gap for development: 0.3 mm
doctor gap: 0.3 mm
main pole angle during collection:
6° upstream of center (doctor side)
main pole angle during development:
center 0° (sleeve and drum closest direction)

An amount of toner grains measured beforehand was deposited on the drum, and the amount of toner grains left on the drum after collection at the developing position was measured by a suck-in method. The result of Experiment 1 is listed in FIGS. 7 and 17.

Figure 7:
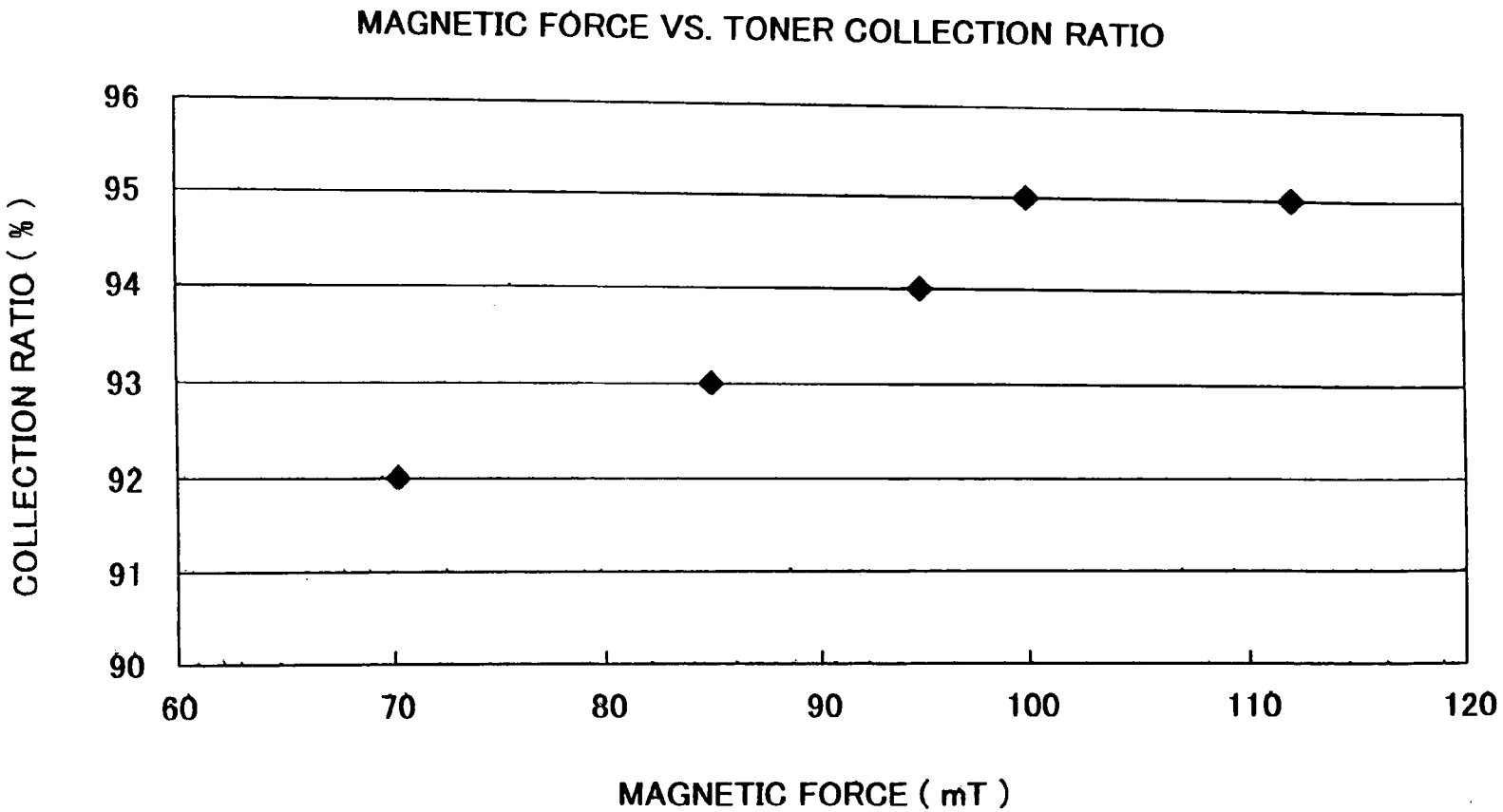
FIG. 7 is a graph showing the result of Experiment 1.

In FIG. 7, the abscissa indicates magnetic forces exerted by magnets in the direction normal to the surface of the sleeve 22M while the ordinate indicates collection ratios, i.e., (amount of input toner−amount of toner left uncollected)/[amount of input toner]×100) (%); the collection ratio is 100% when the entire input toner is collected. As FIG. 7 indicates, the collection ratio increases with an increase in the magnetic force of the main-pole magnet. However, the collection ratio is not different between 100 mT and 112 mT, a desirable collection ratio is achievable if use is made of a magnet exerting a magnetic force of 100 mT or above.

EXPERIMENT 2

Figure 8:
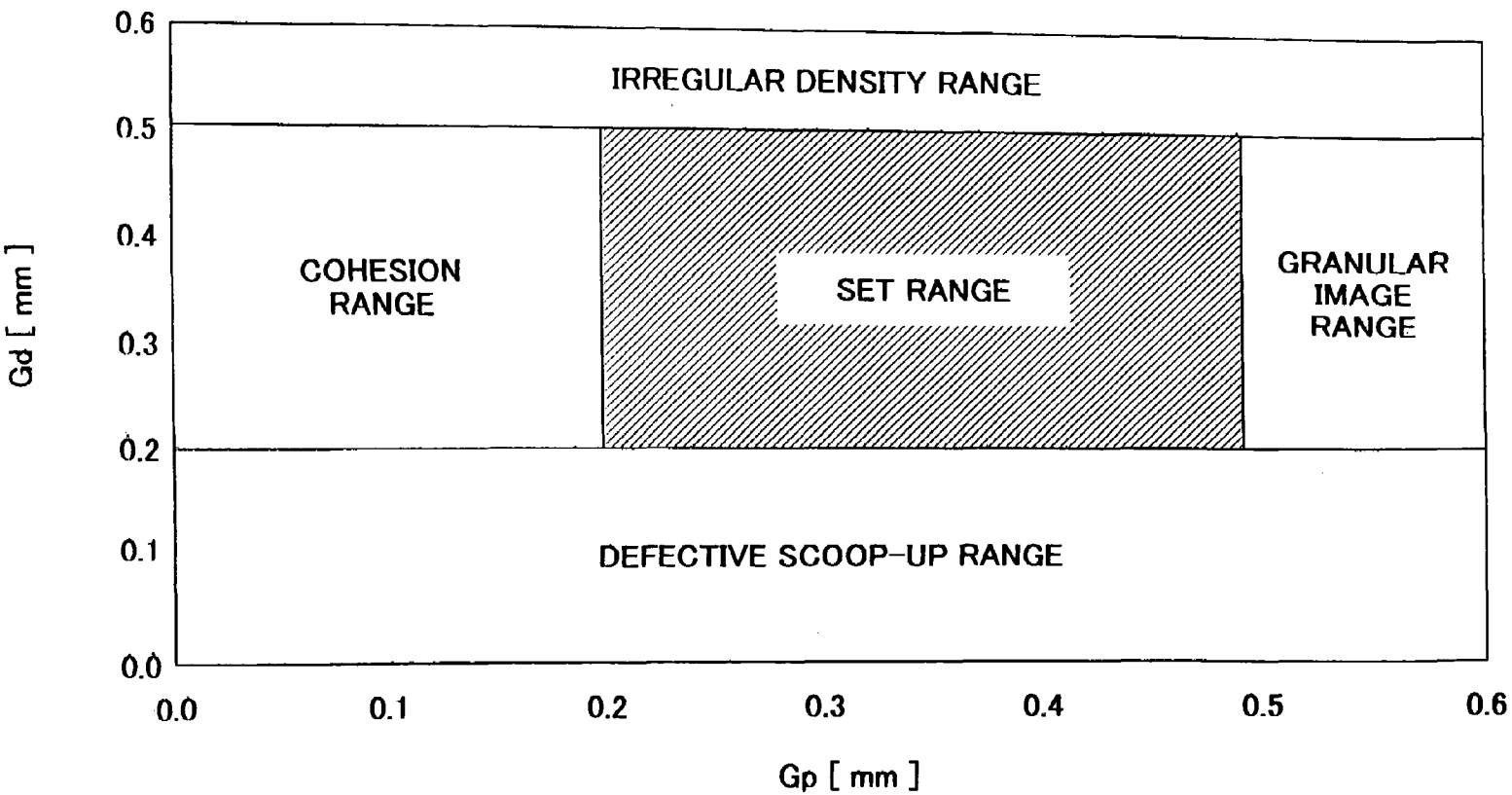
FIG. 8 is a graph showing the results of Experiments 3 and 4.

Experiment 1 was repeated except that the magnetic force of the magnet was increased in order to determine whether or not the fine stripe-like image omission ascribable to the magnetic brush occurred. The result of Experiment 2 is shown in FIG. 8. As shown, the stripe-like image omission occurred when the magnetic force in the direction normal to the surface of the sleeve 22M was 220 mT, but it did not occur when the magnetic force was 200 mT or below.

It will therefore be seen that when the magnetic force in the direction normal to the surface of the sleeve 22M is between 100 mT and 200 mT, there can be achieved desirable toner collection and obviation of stripe-like traces.

In Experiment 1, the ratio of the surface speed Vs of the sleeve 22M to the surface speed Vp of the drum 11M, i.e., Vs/Vp was selected to be 2. The higher the ratio Vs/Vp, the greater the number of times the magnetic brush contacts the drum 11M and therefore the higher the collection ratio. Further, in Experiment 1, use was made of carrier grains with a grain size of as small as 35 μm. Carrier grains with such a small grain size have a greater total area than conventional carrier grains sized 50 μm to 60 μm and therefore contact toner grains over a greater total area. This is also true with the residual toner grains and therefore enhances the cleaning ability. Further, the carrier grains with a small size make the individual brush chains of the magnetic brush thin to thereby promote faithful reproduction of dots of an image.

EXPERIMENT 3

In Experiment 1, the gap for development, i.e., the shortest distance between the sleeve 22M and the drum 11M was selected to be 0.3 mm. The gap would, if excessively small, cause the developer 28M to stop the above gap and would cohere due to frictional heat or would, if excessively great, lower the developing ability and render an image granular with low density. Experiment 3 was identical with Experiment 1 except that the gap for development was varied. The Experiment showed that the gap caused the developer 28M to cohere if smaller than 0.2 mm or rendered an image granular if greater than 0.5 mm.

EXPERIMENT 4

In Experiment 1, the doctor gap, i.e., the shortest distance between the sleeve 22M and the doctor 25M was selected to be 0.3 mm. The doctor gap prevented, if excessively small, the developer 28M from being scooped up and therefore reduced image density or made, if excessively great, the amount of the developer 28M scooped up irregular in the axial direction of the sleeve 22M and therefore made image density irregular.

Experiment 4 is identical with Experiment 1 except that the doctor gap was varied. The doctor gap made, if smaller than 0.2 mm, the scoop-up of the developer 28M defective and made image density low or caused, if greater than 0.5 mm, image density to be irregular.

FIG. 8 shows the results of Experiments 3 and 4 in which the gap Gp for development and doctor gap Gd were varied. As shown, a desirable image was obtained when the gaps Gp and Gd each lied in a particular range. More specifically, high-quality images were formed when the gap for development was 0.2 mm or above, but 0.5 mm or below, and when the doctor gap was also 0.2 mm or above, but 0.5 mm or below.

Now, if the doctor gap Gd is excessively great relative to the development gap Gp, then it is likely that a great amount of developer 28M passed through the doctor portion stops the development gap and causes toner grains to cohere. This problem did not occur if a relation of $Gd \leqq Gp+0.3$ mm was satisfied, as determined by experiments. So long as the gaps Gp and Gd both are between 0.2 mm and 0.4 mm, they satisfy the above relation and therefore obviate the cohesion of toner ascribable to the balance between Gd and Gp.

Further, if the doctor gap Gd is excessively small relative to the development gap Gp, then only the amount of developer 28M to pass through the doctor portion is small and therefore sparse in the development gap Gp, resulting in inefficient development and low image density. It was experimentally found that if a relation of $Gd \geqq Gp-0.3$ mm was satisfied, image density was prevented from being lowered. So long as the gaps Gp and Gd both are between 0.2 mm and 0.5 mm, they satisfy the above relation for thereby preventing image density from being lowered due to a balance between Gd and Gp.

Figure 9A:
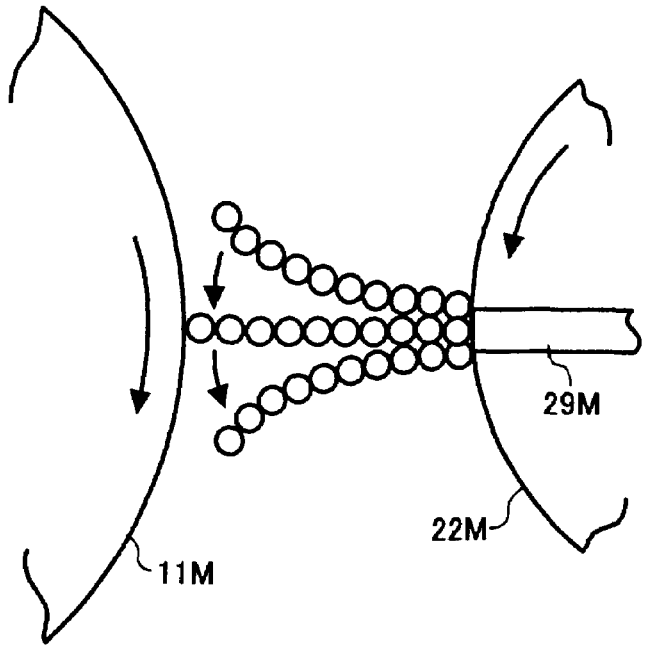
FIG. 9A shows a gap for development in a condition wherein a main-pole magnet is positioned at an angle of 0°.
Figure 9B:
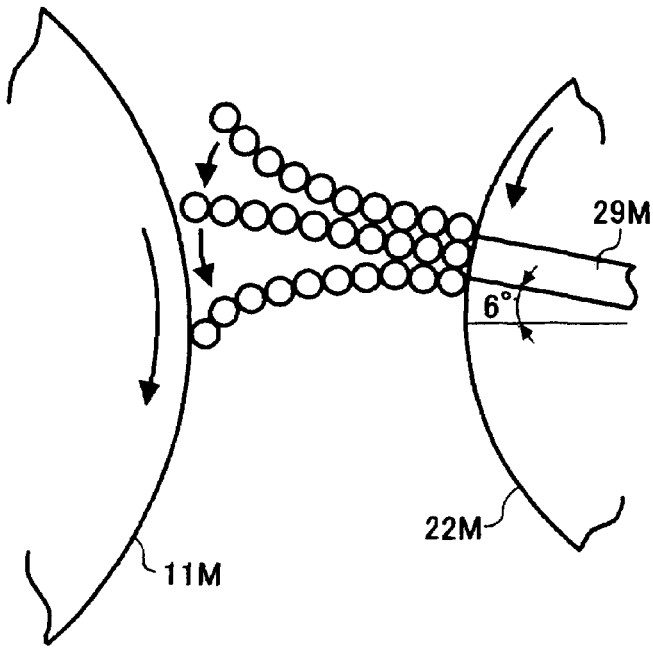
FIG. 9B shows a gap for development in another condition wherein the main-pole magnet is positioned at an angle of 6°.

In Experiment 1, the main-pole magnet 29M was positioned at an angle of 6° upstream of the center in the event of residual toner collection. Reference will be made to FIGS. 9A and 9B for describing the angle of the main-pole magnet 29M more specifically. FIGS. 9A and 9B respectively show the development gap where the angle of the main-pole magnet 29M is 0° and the development gap where the above angle is 6°. In FIG. 9A, the brush chain of the magnetic brush formed by the magnetic force contacts the drum 11M in a linear shape while, in FIG. 9B, the brush chain contacts the drum 11M with its tip being bent toward the downstream side. The configuration of the brush chain is representative of the condition of an electric field. In FIG. 9B, a magnetic field is formed such that the magnetic force in the direction tangential to the drum 11M is strong in the developing zone. Also, when the main-pole magnet 29M is positioned upward, the brush chain contacts the drum 11M while bending toward the downstream side in accordance with the above magnetic field. As a result, a force, tending to cause the tip of the brush chain to bend in the same direction as the rotation of the sleeve 22M, acts on the tip of the brush chain. This increases the frictional force of the magnetic brush acting on the drum 11M for thereby increasing the toner collection ratio.

By contrast, in the event of development, the frictional force mentioned above should preferably be weak. For this purpose, the angle of the main-pole magnet 29M should preferably be 0°, as shown in FIG. 9A.

Even when the main-pole magnet 29M is inclined by 6° toward the downstream side, the magnetic force tangential to the drum 11M in the developing zone is the same as when the main-pole magnet 29M is inclined toward the upstream side. However, the tip of the brush chain contacts the drum 11M while rising from a bent position. Presumably, therefore, a frictional force as strong as one obtainable when the main-pole magnet 29M is inclined toward the upstream side is not achievable.

EXPERIMENT 5

Figure 10:
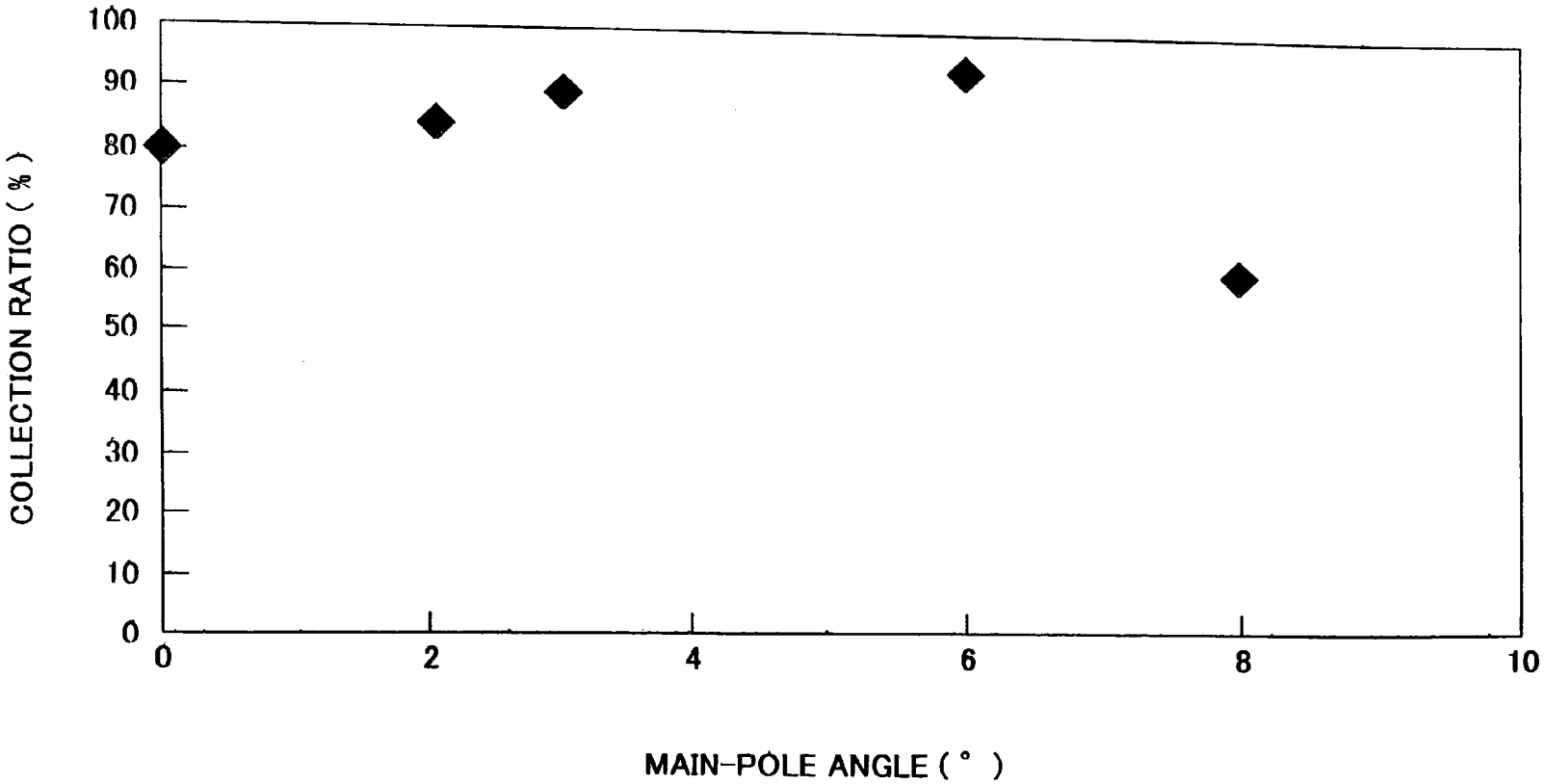
FIG. 10 is a graph showing the result of Experiment 5.

Experiment 1 was repeated except that the angle of the main-pole magnet 29 was varied from 0° to 8° in the direction in which the surface of the sleeve 22M moved for the purpose of estimating the collection ratio. FIGS. 10 and 19 show the experimental results.

It will be seen that the collection ratio increases with an increase in the angle of the main-pole magnet 29M up to 60, but sharply decreases when the above angle is increased to 8°. Why the collection ratio sharply decreases at the angle of 8° is that if the main-pole magnet 29M is excessively inclined, then the magnetic brush cannot contact the drum 11M or, if successfully contacts it, cannot execute a sufficient frictional force.

Although the optimum angle of the main-pole magnet 29M is 6° in Experiment 5, it depends on, e.g., the development gap or the linear velocity ratio between the sleeve 22M and the drum 11M. This, however, does not overturn the fact that by inclining the main-pole magnet 29M toward the upstream side in the event of residual toner collection, it is possible to enhance efficient collection.

While in the illustrative embodiment the charge brush 12M uniformly charges the residual toner grains to a negative or an expected polarity, the former may alternatively charge the latter to a positive or an opposite polarity. In such an alternative case, the bias applied to the charge roller 15M is turned off during a cleaning mode operation, so that the toner grains of opposite polarity do not deposit on the charge roller 15M. Also, a negative bias may be applied to the sleeve 22M in order to electrostatically collect the residual toner grains from the drum 11M.

Although the charge brush 12M is shown as being located upstream of the blade 13M in the direction of rotation of the drum 11M, the former may be positioned downstream of the latter, if desired.

The blade 13M may bifunction as an auxiliary charging member in place of the charge brush 12M in order to reduce the number of constituent parts.

The non-contact type charge roller 15M, serving as charging means in the illustrative embodiment, may be replaced with a contact type charge roller or non-contact charger type of charging means. However, the problem with the charger type of charging means is that ozone, nitrogen oxides and other toxic discharge products, undesirable from an environmental aspect, are generated in a great amount because a great amount of discharge is necessary for charging the drum surface to a preselected potential. By contrast, the contact or the adjoining type of charging system produces only a smaller amount of toxic compounds because of a small amount of discharge.

In the illustrative embodiment, the drum 11M and sleeve 22M are rotated such that their surfaces move in the same direction as each other. Alternatively, the drum 11M and sleeve 22M may be rotated in the same direction with their surfaces moving in opposite directions at the facing position. In this case, although the linear velocity ratio of the sleeve 22M to the drum 11M, Vs/Vp, may be smaller than 2, the tips of the brush chains are apt to more strongly contact the drum 11M when the above surfaces move in opposite directions to thereby make image quality lower than when the two surfaces move in the same direction.

As stated above, the illustrative embodiment, pertaining to an image forming apparatus of the type causing residual toner grains to be collected by a developing unit 20M, has various unprecedented advantages, as will be described hereinafter. A DC voltage is applied for the collection of residual toner gains to thereby form an electric field that causes the toner grains to move from the drum 11M toward the sleeve 22M. An AC voltage is undesirable because it is apt to cause toner grains, which are adhered to a magnetic brush formed on the sleeve 22M by rubbing and electric field, to again deposit on the drum 11M due to the variation of electric field. By contrast, the illustrative embodiment uses a DC voltage for allowing a minimum amount of residual toner grains deposited on the charge brush 12M to again deposit on the drum 11M.

In the illustrative embodiment, use is made of a magnet whose force in the direction normal to the surface of the sleeve 22M is as strong as 100 mT or above. Such a magnet increases a force that causes the sleeve 22M to attract the magnetic brush formed by the carrier grains, thereby making the magnetic brush dense, i.e., reducing voids in the magnetic brush. Consequently, the electric resistance of the magnetic brush is lowered to allow the toner in the developing zone to more faithfully move in the electric field between the sleeve 22M and the drum 11M. This is true not only during development but also during residual toner collection.

The force on the sleeve 22M is strong enough to make the magnet brush hard, so that the magnetic brush contacts the drum 11M with a stronger rubbing force. This promotes effective collection of the residual toner grains from the drum 11M. However, if the rubbing force is excessively strong, then the magnetic brush scrapes off a toner image to leave fine white stripes ascribable to the magnetic brush in the resulting image. To solve this problem, the illustrative embodiment limits the magnetic force in the normal direction to 200 mT or below.

The blade or toner holding means 13M is positioned between the image transfer position and the position where the drum 11M is charged by the charge roller 15M, and is brought into contact with the drum 11M in the event of development, preventing the residual toner grains from existing in the image forming zone or the charging zone at the time of development. This successfully obviates an occurrence that toner grains deposit on the drum 11M during latent image formation and prevent a latent image from being faithfully formed on the drum 11M. Further, because toner grains are absent on the drum 11M at the time of charging, the charge roller 15M can uniformly charge the toner grains. In addition, the distance the drum 11M moves from the charging position to the developing position is minimized, reducing the variation of the potential on the drum surface.

Between consecutive developing steps and after image formation, the blade 13M is released from the drum 11M to allow the residual toner grains temporarily held thereby to be returned to the drum 11M and then collected by the developing unit 20M.

The charge brush or auxiliary charging member 12M again charges part of the residual toner grains charged to a positive or an opposite polarity to a negative polarity, thereby charging the entire residual toner to a negative polarity. This further promotes the movement of the toner from the drum 11M to the sleeve 22M at the time of collection.

The shortest distance between the drum 11M and the sleeve 22M is selected to be 0.2 mm or above in order to prevent the developer 28M from stopping an excessively narrow development gap and generating heat due to friction, preventing the developer 28M from cohering. Further, the development gap is selected to be 0.5 mm or below in order to prevent the developing ability from being lowered due to an excessively broad development gap, obviating granular images with low density.

The doctor gap, or shortest distance, between the sleeve 22M and the doctor 25M is also selected to be 0.2 mm or above. This obviates an occurrence that the doctor gap is so narrow, the amount of developer 28M on the sleeve 22M becomes short and lowers image density. Also, the doctor gap is selected to be 0.5 mm or below so as to obviate irregular image density in the axial direction ascribable to an excessively broad doctor gap.

The main-pole magnet 29M, exerting a magnetic force in the developing zone, is directed to the upstream side by 60 in the event of residual toner collection than in the event of development. Therefore, at the shortest distance position, the carrier grains form a brush chain suitable in shape for collection to thereby increase the collection ratio.

The linear velocity ratio of the surface of the sleeve 22M to the surface of the drum 11M, Vs/Vp, is selected to be 2, increasing the number of times the magnetic brush contacts the surface of the drum 11M. The greater the number of times the magnetic brush contacts the drum 11M, the higher the collection ratio.

Use is made of carrier grains, which form part of the two-ingredient type developer 28M, having a grain size as small as 35 μm and therefore a broader total surface area than conventional carrier grains having a grain size ranging from 50 μm to 60 μm. This increases the area over which the carrier grains contact the toner grains also as the area over which the carrier grains contact the residual toner grains, thereby enhancing the collection of the residual toner grains. In addition, such small carrier grains make the chains of the magnetic brush thin for thereby enhancing the faithful reproduction of dots of an image.

The charge roller 15M, developing unit 20M and other process means are constructed into a single process cartridge 1M. Therefore, when any part contained in the process cartridge 1M reaches the end of life or needs maintenance, it suffices to replace the process cartridge 1M.

Furthermore, with the cleaning system of the illustrative embodiment, it is possible to enhance the collection of residual toner grains in the case of cleaning of the type causing a developing unit 20M to collect toner grains.

A modification of the illustrative embodiment will be described hereinafter. In the modification, different voltages are applied from a power supply, not shown, to the doctor 25M at the time of residual toner collection and development so as to enhance both of residual toner collection and development. Stated another way, the doctor 25M plays the role of electric field forming means for applying a particular electric field for each of development and residual toner collection also, as will be described hereinafter.

Figure 11A:
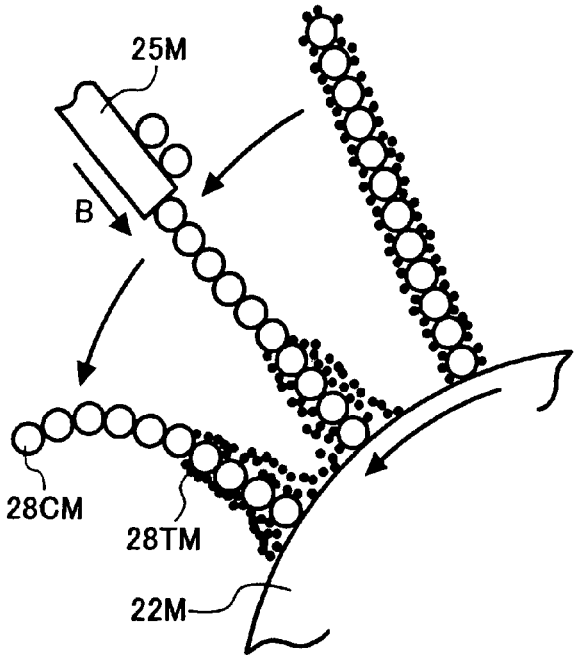
FIG. 11A is an enlarged view showing a doctor portion in a residual toner collecting condition.
Figure 11B:
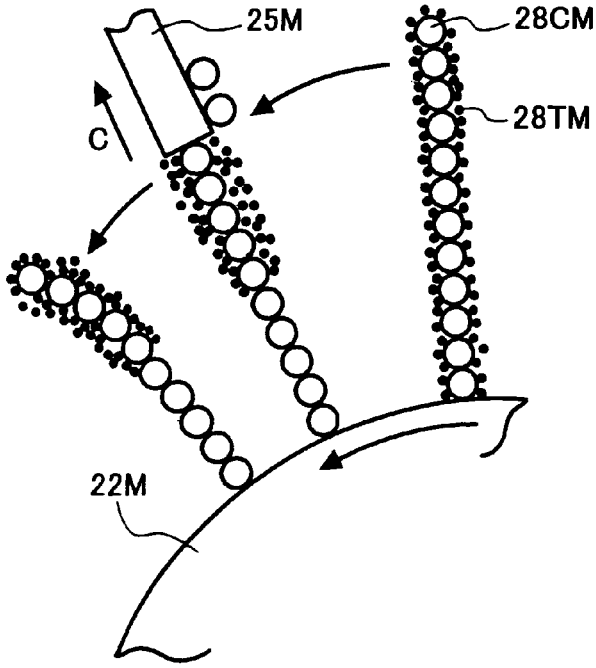
FIG. 11B is a view similar to FIG. 11A, showing the doctor portion in a developing condition.

FIGS. 11A and 11B are enlarged views showing conditions around the doctor 25M at the time of residual toner collection and development, respectively. As shown in FIG. 11A, in the event of residual toner collection, an electric field for causing toner grains 28TM contained in the developer 28M to move toward the sleeve 22M, as indicated by an arrow B, is formed between the doctor 25M and the sleeve 22M, so that the toner grains 28TM move toward the sleeve 22M when the developer 28M is passing the doctor 25M. As a result, the coverage of, among carrier grains 28CM forming a magnetic brush moved away from the doctor 25M, the carrier grains 28CM adjacent to the tip with the toner grains 28TM decreases. Therefore, when the magnetic brush reaches the developing zone, it easily collects the residual toner because the carrier grains 28CM are exposed to the outside on the magnetic brush.

On the other hand, as shown in FIG. 11B, an electric field for causing the toner grains TM to move toward the doctor 25M, as indicated by an arrow C, is formed between the doctor 25M and the sleeve 22M at the time of development, causing the toner grains 28TM to move toward the tip of the magnetic brush. Consequently, the coverage of the carrier grains 28CM with the toner grains 28TM increases at the tip portion of the magnetic brush, so that the toner grains 28TM easily move toward the drum 11M and improve the developing ability.

Assume that the amount of charge Q deposited on the toner is negative and that the voltage applied to the doctor 25M is V1 at the time of residual toner collection or V2 at the time of development. Then, the voltages applied to the doctor 25M are so selected as to satisfy the following relations relative to a voltage Vb applied to the sleeve 22M:

$$(V1-Vb)\leqq 0 \text{ and } (V2-Vb)\geqq 0$$

At the time of residual toner collection, the toner grains of negative polarity move toward the sleeve 22M because of the relation (V1−Vb)≦0. At the time of development, the toner grains of negative polarity move toward the doctor 25M because of the relation (V2−Vb)≧0. When the amount of charge deposited on the toner grains is positive, the voltages applied to the doctor 25M are so selected as to satisfy the following relations:

$$(V1-Vb)\geqq 0 \text{ and } (V2-Vb)\leqq 0$$

As stated above, by forming electric fields between the doctor 25M and the sleeve 22M for causing the toner grains 28TM to move, it is possible to implement both of a cleaning system having a high collection ratio and a high-quality developing system insuring faithful development of a latent image.

EXPERIMENT 6

Figure 12:
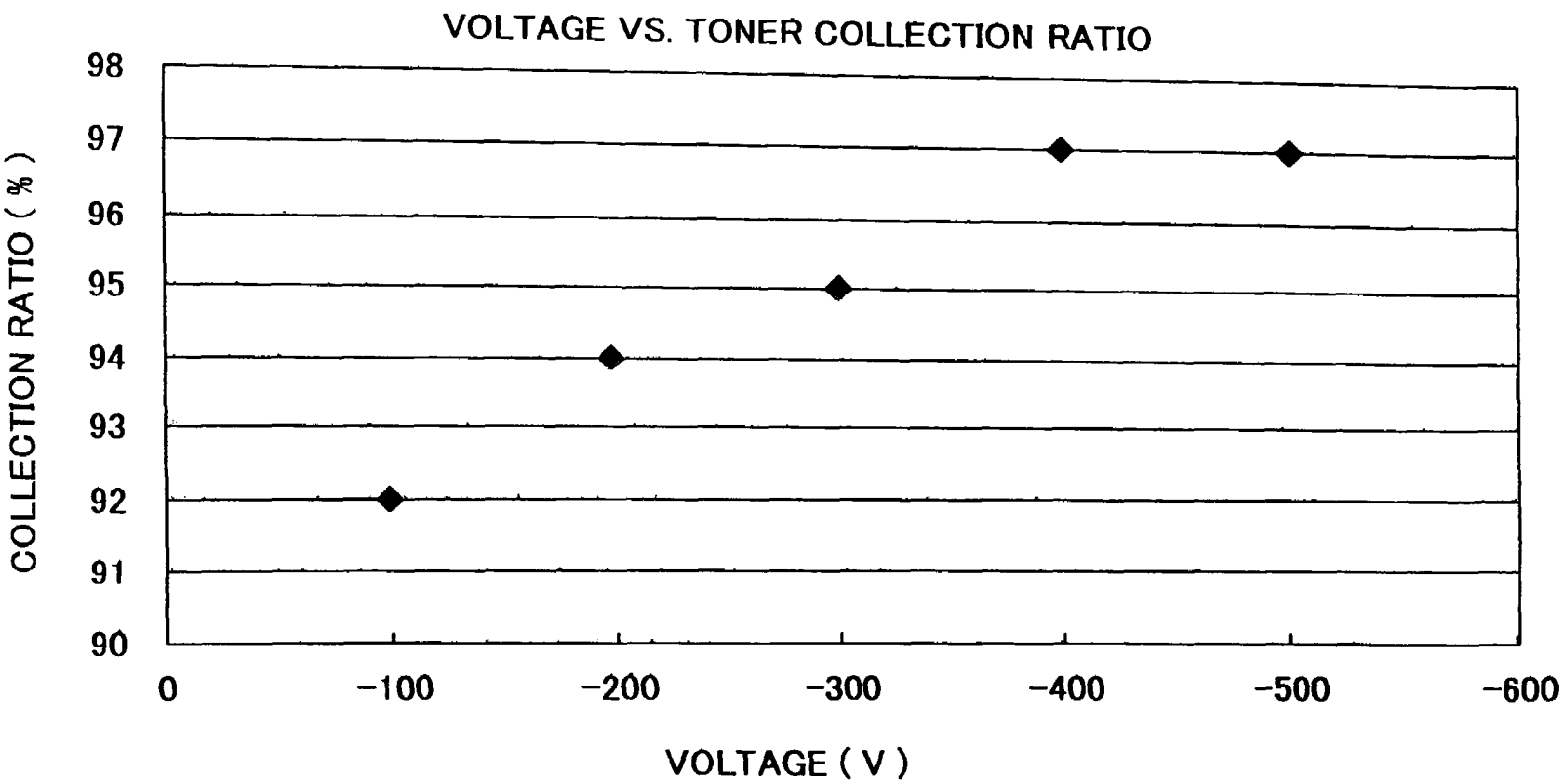
FIG. 12 is a graph showing the result of Experiment 6.

The voltage applied to the doctor 25M was varied under the same conditions as Experiment 1 in order to determine the variation of the collection ratio. The toner grains were charged to negative polarity while use was made of a magnet exerting a magnetic force of 100 mT for the developing roller. FIGS. 12 and 20 show the result of Experiment 6.

Experiment 6 showed that the electric field applied between the doctor 25M and the sleeve 22M at the time of residual toner collection improved the collection ratios of the residual toner.

As FIGS. 12 and 20 indicate, collection ratios achievable with −400 V and −500 V are not different from each other because −400 V applied to the doctor 25M was sufficient for the toner grains on the magnetic brush to move toward the sleeve 22M. Also, even when a voltage higher than −400 V to the negative side is applied to the doctor 25M, the collection ratio of residual toner grains is not higher than when −400 V is applied. For these reasons, the modification applies a voltage of −400 V to the doctor 25M at the time of residual toner collection or applies −200V to the same at the time of development.

It is known that carrier chains, forming a magnetic brush on a sleeve, each have its tip portion bent or turns in such a manner that the tip and root replace with each other. Presumably, however, the individual carrier chain recently does not turn in such a manner than the tip and root thereof replace with each other, but simply turns such that the tip portion bends or such that only carrier grains deposited on the tip portion replace with each other because of the decreasing radius and increasing rotation speed of a sleeve. If toner grains deposited on each carrier chain are not sufficiently moved toward the root side and if carrier grains, turning as mentioned above, include carrier grains with high coverage, then the portion of the carrier chain with the high coverage contacts a drum and is apt to obstruct the collection of residual toner.

Further, Experiment 6 shows that even if a voltage higher than −400 V to the negative side is applied to the doctor 25M, the collection ratio of residual toner grains is not improved at all. It is therefore considered that a voltage of −400 V maintains the coverage of the toner grains with the carrier grains sufficiently low within the range in which bending and turning stated above occur.

While the doctor 25M bifunctions as an electric field forming means in the above modification, an electric field forming member may be provided independently of the doctor 25M. In such a case, the electric field forming member will be positioned between the doctor 25M and the developing zone because the length of the magnetic brush is not regulated at the upstream side of the doctor 25M.

The modification of the first embodiment described above has the following advantages. The doctor 25M serves as an electric field forming means also. Assume that the amount of charge Q deposited on the toner grains is negative and that the voltage V1 is applied to the doctor 25M at the time of residual toner collection, then the voltage V1 is so selected as to satisfy a relation:

$$(V1-Vb)\leqq 0$$

where Vb is a voltage applied to the sleeve 22M. In this condition, the toner grains of negative polarity can move toward the sleeve 22M. This successfully reduces the coverage of the carrier with the toner at the tip portion of a magnet brush and thereby increases the collection ratio of the residual toner grains at the tip of the magnetic brush that contacts the drum 11M.

Assuming that the voltage applied to the doctor 25M at the time of development is V2, then the voltage V2 is so selected as to satisfy a relation:

$$(V2-Vb)\geqq 0$$

In this condition, the toner grains of negative polarity can be moved toward the tip portion of the magnetic brush to thereby increase the coverage of the carrier with the toner at the tip portion of the magnetic brush. Consequently, faithful development of a latent image and therefore high image quality is achievable.

When the doctor 25M plays the role of electric field forming means also, an independent, electric field forming member is not necessary, reducing the number of parts and therefore the overall size of the apparatus.

Another modification of the illustrative embodiment will be described hereinafter. In the previous embodiment, the residual toner grains are stopped at the time of development and then released between paper sheets or at the end of development to be collected by the developing unit. In another modification, the cleaning system of the illustrative embodiment is applied to an image forming apparatus of two rotations, one development system. In the two rotations, one development type of apparatus, a developing unit performs development during the first rotation of a drum and then performs the collection of residual toner grains during the second rotation.

In this type of image forming apparatus, too, it is possible to prevent toner grains once collected from again depositing on the drum by applying a DC voltage that forms an electric field preventing the toner once collected from again depositing on the drum. In addition, with a main-pole magnetic field that generates a magnetic force of between 100 mT and 200 mT in the developing zone, it is possible to enhance the efficient collection of residual toner grains.

Second Embodiment

In the first embodiment, the toner holding means for holding the residual toner grains left on the drum 11M after image transfer is implemented as a blade 13M. In a second embodiment to be described hereinafter, the toner holding means is implemented as a magnet brush roller 41. Arrangements identical with those of the first embodiment will not be described specifically in order to avoid redundancy.

Figure 13:
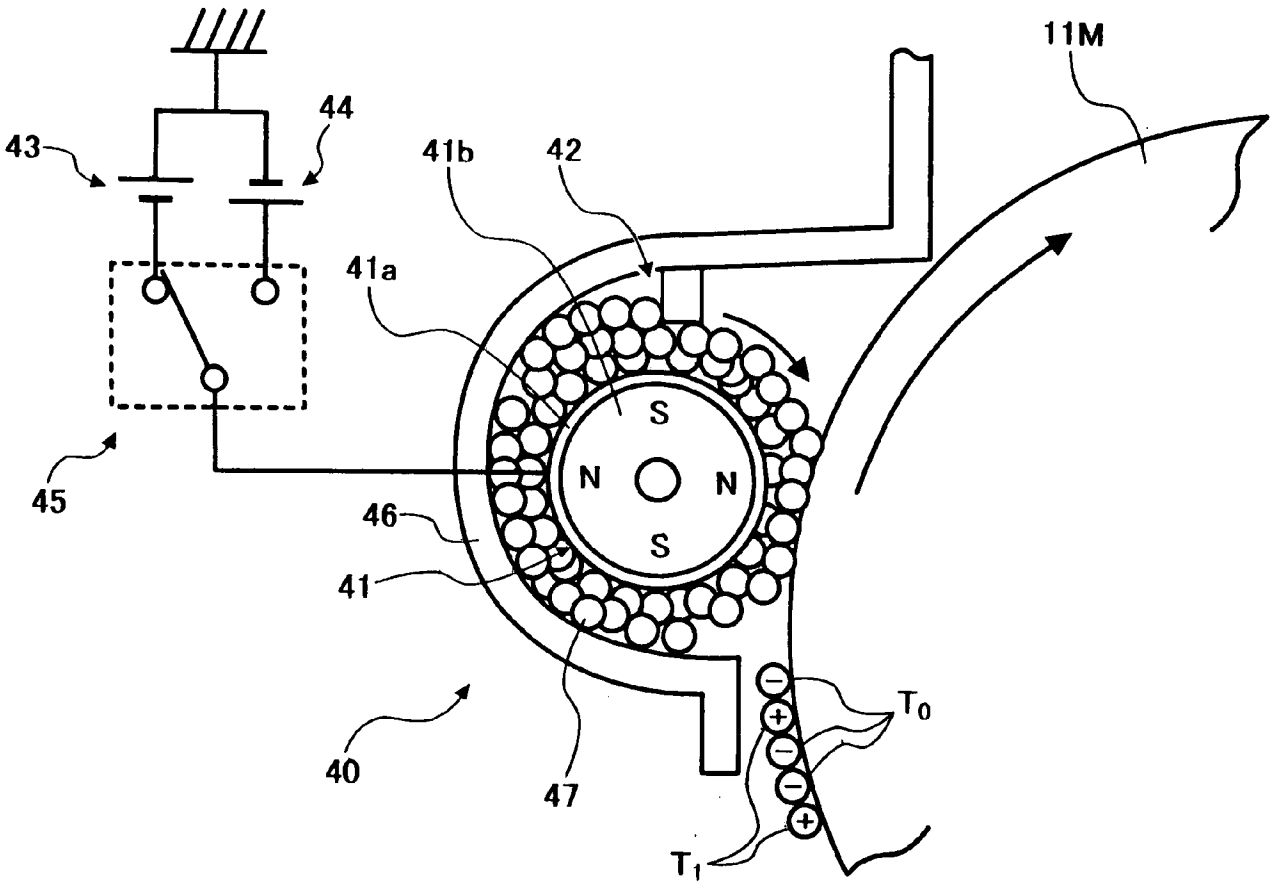
FIG. 13 shows a toner holding device representative of a second embodiment of the present invention.

As shown in FIG. 13, the second embodiment includes a toner holding device 40 including a magnet brush roller 41, which plays the role of a toner holding member. The drum 11M, facing the magnet brush roller 41, is an organic photoconductor having an outside diameter of 30 mm. The magnet brush roller 41 is made up of a rotary sleeve 41*a* and a stationary magnet roller or magnetic field generating means 41*b* disposed in the sleeve 41*a* and having a diameter of 10 mm. The sleeve 41*a* is formed of a conductive, nonmagnetic material and provided with a diameter of 16 mm. Generally V-shaped grooves are formed in the circumferential surface of the sleeve 41*a* at a pitch of 0.8 mm, and each is 0.2 mm deep.

The sleeve 41*a* with the above configuration is rotated by a drive source, not shown, clockwise, as viewed in FIG. 13, in the same manner as, but at a higher speed than, the drum 11M. The rotation speed of the sleeve 41*a* should preferably be 1.0 times to 3.0 times, more preferably 1.5 times to 2.0 times, of the rotation speed of the drum 11M. The magnet roller 41*b* includes N-pole and S-pole magnets arranged alternately with each other. The toner holding device 40 further includes a casing 46 storing magnetic grains, i.e., carrier grains 47. The sleeve 41*a* and drum 11M are spaced from each other by a gap of 0.4 mm to 0.5 mm. The width over which the magnet brush roller 41 and drum 11M contact, i.e., a nip is selected to be about 5 mm to about 6 mm.

Because the illustrative embodiment does not use a blade contacting the drum 11M, it noticeably reduces load torque to act on a drive source assigned to the drum 11M. However, the illustrative embodiment cannot hold the residual toner grains left on the drum 22M as positively as the first embodiment. As a result, it is likely that additives separated from the toner grains firmly adhere to the surface of the drum 11M in the form of a film, i.e., so-called toner filming occurs. Although the amount of residual toner grains stated above may decrease if use is made of so-called spherical toner grains, toner filming is still apt to occur after a long time of use. In light of this, in the illustrative embodiment, the surface of the magnet brush roller 41 is caused to move in the opposite direction to the surface of the drum 11M. This configuration scrapes off additives deposited on the surface of the drum 11M more strongly than a configuration causing the magnet brush roller 41 to follow the rotation of the drum 11M or a configuration driving the former in the same direction as the latter, thereby obviating toner filming.

A first and a second power supply 43 and 44, respectively, selectively apply a bias to the magnet brush roller 41. More specifically, a switch 45 is connected between the power supplies 43 and 44 and the magnet brush roller 41 and controlled by a control unit, not shown, to selectively connect the power supply 43 or 44 to the magnet brush roller 41. In the illustrative embodiment, the first power supply 43 applies a hold bias that makes the surface potential of the magnet brush roller 41-50 V while the second power supply 44 applies a release bias that makes the above potential −350 V. The illustrative embodiment further includes a blade or metering member 42 configured to regulate the thickness of the magnetic brush formed on the magnet brush roller 41. The blade 42 is spaced from the sleeve 41*a* by a gap of 0.6 mm to 0.8 mm.

The carrier grains 47 stored in the toner holding device 40 are the same as the carrier grains stored in the developing unit. More specifically, the carrier grains 47 are coated with silicone resin for negatively chargeable toner, provided with a mean grain size of 50 μm and provided with low to medium resistance of $10^6$ Ω·cm to $10^{12}$ Ω·cm. The resistance of the carrier grains 47 is measured by a method that places two 4×5 mm electrode plates at a distance of 2 mm, packs carrier grains in the space between the electrode plates and applies a voltage of 100 V. In this manner, in the illustrative embodiment, a magnetic brush can be formed by carrier grains of low to medium resistance and can therefore reverse the direction of the electric field acting on the brush tip more easily than a fur brush roller.

The carrier grains 47 stored in the casing 46 are conveyed by the sleeve 41*a* toward the drum 11M while forming a magnetic brush due to the magnetic field of the magnet roller 41*b*. The magnetic brush is metered by the blade 42 in the axial direction of the sleeve 41*a* to be provided with a uniform thickness. On contacting the drum 11M, the magnetic brush collects the residual toner grains left on the drum 11M while being applied with the hold bias from the first power supply 43. The hold bias is substantially the same as the surface potential, which is −50 V to −100 V, of the drum 11M left thereon after image transfer, so that no potential difference occurs between the drum 11M and the magnet brush roller 41. Consequently, an electrostatic attracting force ascribable to a potential difference between the drum 11M and the magnet brush roller 41 does not act on the residual toner grains, allowing the magnetic brush to hold the residual toner grains with a frictional force without regard to the polarity of the residual toner grains.

The mean amount of charge deposited on residual toner grains collected by the magnetic brush was measured to be −10 μC/g to −15 μC/g, which was greater than −2 μC/g deposited on the residual toner grains after image transfer. Also, the residual toner grains held by the magnetic brush were grains $T_0$ of expected polarity. This is because when the magnetic brush collects the residual toner grains from the surface of the drum 11M, the magnetic brush electrifies the residual toner grains. Therefore, among the residual toner grains, toner grains $T_1$ of positive or opposite polarity become toner grains $T_0$ of negative or expected polarity by friction acting between them and the magnetic brush. Likewise, the amount of charge deposited on, among the residual toner grains, the toner grains $T_0$ of negative or expected polarity becomes higher due to friction with the magnetic brush. As a result, the amount of negative charge deposited on the residual toner grains held by the magnetic brush increases, compared to the amount of charge left on the toner grains just after image transfer.

As stated above, the residual toner grains held by the magnetic brush are returned to the surface of the drum 11M at preselected timing. More specifically, the switch 45 is switched from the first power supply 43 to the second power supply 44 at preselected timing to thereby apply the release bias of −350 V to the magnet brush roller 41. The resulting potential difference between the drum 11M, about −50 V, and the magnetic brush roller 41, −350 V, causes the residual toner grains charged to negative polarity by friction to eletrostatically adhere to the drum 11M. Consequently, the residual toner grains held by the magnet brush are again returned to the surface of the drum 11M.

The switch 45 is operated at such timing that a latent image is not formed when the residual toner grains returned to the drum 11M pass through the latent image forming zone. For example, when the trailing edge of an image formed on the drum 11M during one image forming cycle reaches the hold nip, the switch 45 is switched from the first power supply 43 to the second power supply 44 to thereby apply the release bias to the magnetic brush. Subsequently, when the portion of the surface of the drum 11M to be uniformly charged by the charge roller 15M first during the next image forming cycle reaches the hold nip, the switch 45 is switched to the second power supply 43. Then, the release bias applied to the magnetic brush is replaced with the hold bias with the result that the residual toner grains held by the magnetic brush stops being released to the surface of the drum 11M. By switching the switch 45 at such timing, it is possible to prevent the residual toner grains from existing on the drum surface when a latent image is being formed on the drum surface. This obviates an occurrence that the residual toner grains form hidden, or non-exposed, portions and thereby form white spots in a solid black portion and other image defects.

If desired, a cleaning mode may be effected at the start-up or the end of operation of the apparatus or after the image forming cycle has been repeated a preselected number of times, switching the switch 45 to the second power supply 44. In such a cleaning mode, an image is not formed, so that the residual toner grains released from the magnetic brush are prevented from forming hidden or non-exposed portions.

The residual toner grains released from the magnetic brush are collected by the magnetic brush formed on the sleeve 22M in the developing zone in the same manner as in the first embodiment.

The illustrative embodiment with the above configuration has various advantages, as will be described hereinafter. The magnet brush roller 41, serving as a toner holding member, noticeably reduces load torque to act on a drive source assigned to the drum 11M, compared to a blade contacting the drum 11M.

Because the magnet brush roller 41 temporarily holds the residual toner grains, the residual toner grains can be electrified by the magnetic brush. This allows the amount of negative charge deposited on the residual toner grains to be increased and allows the toner grains of opposite polarity to be inverted to expected or negative polarity.

The surface of the sleeve 41*a* rotates in the opposite direction to the surface of the drum 11M, as seen at the hold nip, so that the tips of many brush chains contact the sleeve 41*a* while the surface of the drum 11M is passing through the hold nip. Further, the above configuration scrapes off the additives of toner grains deposited on the surface of the drum 11M more positively than the configuration wherein the magnet brush roller 41 follows the rotation of the drum 11M or is driven in the same direction as the drum 11M, obviating toner filming.

While the carrier grains 47 used in the illustrative embodiment have the same grain size, use may be made of carrier grains having two or more different grain size distributions. For example, use may be made of magnetic grains with a grain size of between 70 μm and 100 μm and magnetic grains with a grain size of between 20 μm and 50 μm. Carrier grains with a large grain size would fail to make the carrier grains dense when used alone while carrier grains with a small grain size would cause the tips of brush chains to fall on contacting the drum 11M because of a short magnetic restraining force when used alone. Thus, by using both of carrier grains with a large grain size and carrier grains with a small grain size, it is possible to form a dense magnetic brush capable of exerting a strong magnetic restraining force.

Third Embodiment

A third embodiment of the present invention will be described hereinafter with reference to FIG. 14. While in the first embodiment the toner holding member for temporarily holding the residual toner grains collected from the drum 11M is positioned upstream of the charge roller 15M, such a position of the toner holding member is only illustrative. In the third embodiment to be described hereinafter, toner holding means is positioned between the charge roller 15M and the latent image forming zone. Parts and elements identical with those of the first embodiment will not be described specifically in order to avoid redundancy.

Figure 14:
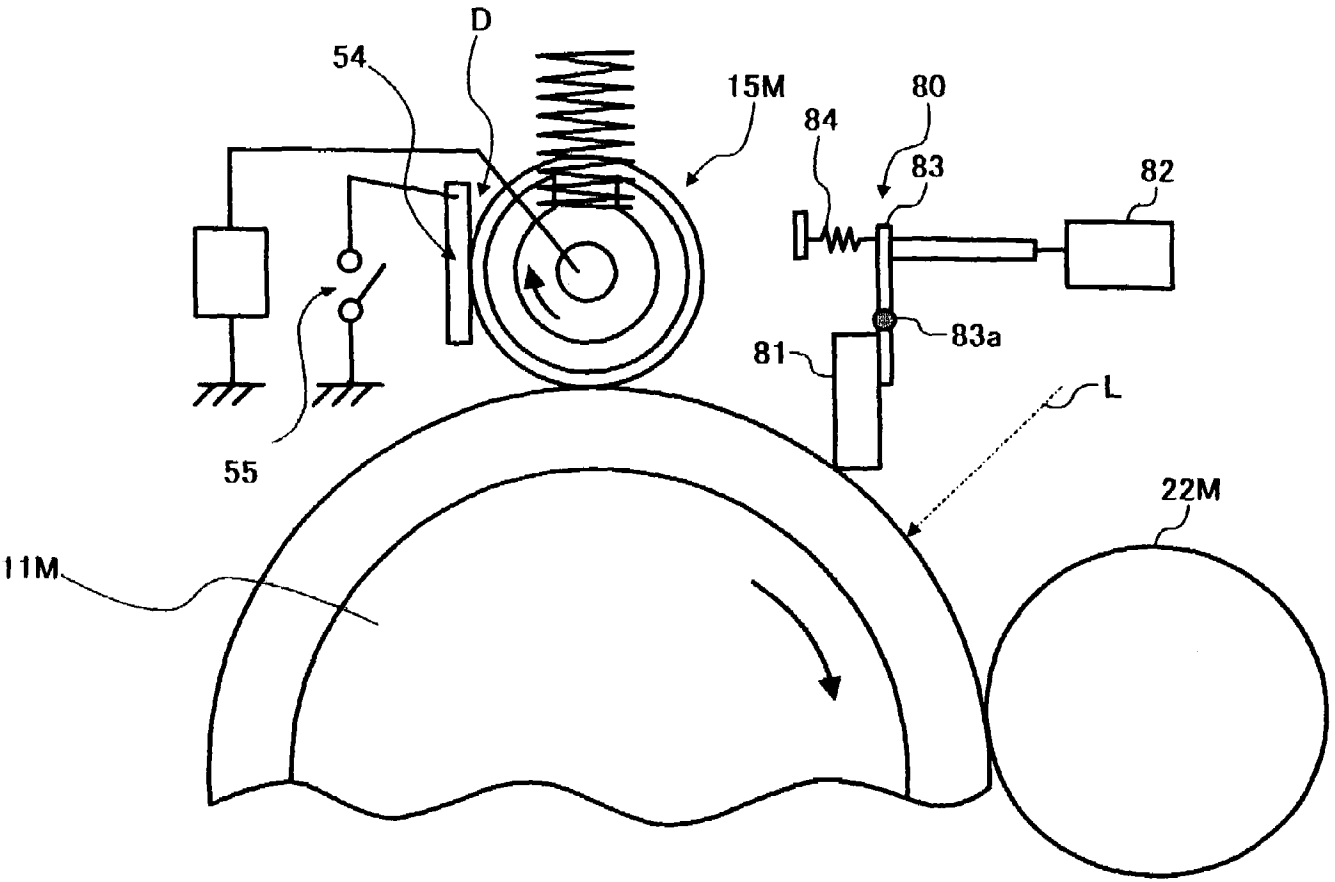
FIG. 14 shows a toner holding device representative of a third embodiment of the present invention.

As shown in FIG. 14, a toner holding device 80, including an elastic blade or toner holding member 81, is shown. As shown, because toner holding means is absent upstream of the charging position, the residual toner grains, partly charged to positive or opposite polarity, are conveyed by the drum 11M to the position where the drum 11M and charge roller 15M face each other. The charge roller 15M, charged to negative polarity, electrostatically collects the toner grains of positive or opposite polarity. On the other hand, the toner grains of negative polarity identical with the polarity of the charge bias do not deposit on the charge roller 15M, but are held by the toner holding device 80 downstream of the charge roller 15M. As shown in FIG. 4, the toner holding device 80 is positioned upstream of the optical writing unit or latent image forming means 2.

The elastic blade 81, included in the toner holding device 80, is mounted on one end of a support plate 83 while a spring 84 and a solenoid 82 are connected to the other end of the support plate 83. The spring 84 constantly biases the support plate 83 leftward, as viewed in FIG. 14. The support plate 83 is angularly movably mounted on a process cartridge at a support portion 83*a*, which is positioned at the intermediate portion of the support plate 83.

In the event of development, the solenoid is energized to pull the support plate 83 against the action of the spring 84. Consequently, the support plate 83 is angularly moved clockwise, as viewed in FIG. 14, about the support portion 83*a*, pressing the elastic blade 81 against the drum 11M with preselected pressure. The solenoid 82 is continuously energized when the optical writing unit 2 is forming a latent image on the drum 11M, maintaining the elastic blade 81 in contact with the drum 11M. The blade 81 therefore fully stops the residual toner grains brought thereto by the drum 11M.

When a latent image is not formed, the solenoid 82 is deenergized with the result that the support plate 83 is pulled to the left, as viewed in FIG. 14, by the spring 84 and turned counterclockwise about the support portion 83*a*. Consequently, the elastic blade 81 is released from the drum 11M and therefore returns the residual toner grains to the surface of the drum 11M. The residual toner grains are then conveyed by the drum 11M to the developing zone via the latent image forming zone and then collected by the developing unit 20M.

As stated above, the elastic blade 81 is brought into contact with the drum 11M when a latent image is being formed by the optical writing unit 2 or brought out of contact with the drum 11M when a latent image is not being formed. Therefore, the residual toner grains do not deposit on the surface of the drum 11M passing through the latent image forming zone when a latent image is being formed on the drum 11M by the optical writing unit 2. This prevents the residual toner grains from forming non-exposed portions which would result in white spots or similar image defects.

Because the drum 11M is charged to negative polarity, toner grains of positive or opposite polarity adhere to the drum 11M more firmly than the toner grains of negative or expected polarity, so that the toner grains with opposite polarity are apt to pass through the gap between the elastic blade 81 and the drum 11M. It is therefore necessary to strongly press the elastic blade 81 against the drum 11M for allowing the blade 81 to hold the toner grains of opposite polarity. In this respect, in the illustrative embodiment, the charge roller 15M temporarily holds the toner grains of opposite polarity at a position upstream of the elastic blade 81, so that all the residual toner grains held by the elastic blade 81 are of expected polarity. Because the toner grains of expected polarity do not strongly adhere to the drum 11M and can therefore be surely held by the elastic blade 81 even if the blade 81 is not strongly pressed against the drum 11M. This successfully reduces stress acting on the elastic blade 81 and drum 11M for thereby extending their lives. Further, it is possible to surely prevent the residual toner grains from passing through the latent image forming zone when the exposing means is in operation. In addition, conditions required of the elastic blade 81 can be easily set.

As shown in FIG. 14, a charge injection plate 54 is positioned on the charge roller 15M for temporarily holding the toner grains of positive or opposite polarity deposited on the charge roller 15M. The charge injection plate 54, pressed against the charge roller 15M by preselected pressure, limits the amount of toner grains to pass through the gap between the charge roller 15M and the charge injection plate 54 to 0.1 $mg/cm^2$ or below, preferably 0.05 $mg/cm^2$ or below, thereby obviating irregular charging. Further, the charge injection plate 54 is formed of stainless steel or similar metal and connected to a switch 55 at one end.

When the optical writing unit 2 is forming a latent image on the surface of the drum 11M, the switch 55 is opened to maintain the charge injection plate 54 in a floating state. On the other hand, when a latent image is not being formed, the switch 55 is closed to connect the charge injection plate 54 to ground with the result that the potential of the charge injection plate 54 becomes 0 V. The resulting potential difference between the charge injection plate 54 and the charge roller 15M causes a negative bias to be applied from the charge roller 15M to the charge injection plate 54. Consequently, the toner grains of opposite polarity held in a region D between the charge roller 15M and the charge injection plate 54 are again charged to negative polarity, again deposited on the surface of the drum 11M and then conveyed to the developing zone via the gap between the charge roller 15M and the drum 11M.

As stated above, the illustrative embodiment temporarily holds the toner grains of opposite polarity with the charge roller 15M and injects a charge in the above toner grains with the charge injection plate 54, surely charging the toner grains of opposite polarity to expected polarity. As a result, the residual toner grains are entirely charged to negative polarity when brought to the developing zone.

In the illustrative embodiment, the charge brush or auxiliary charging member 12M may be positioned upstream of the charge roller 15M and held in contact with the drum 11M as in the first embodiment. In this configuration, the residual toner grains deposited on the drum 11M pass the charge brush 12M with the residual toner contacting the charge brush 12M. As a result, a charge is injected in the residual toner grains to invert the polarity of toner charged to positive or opposite polarity to negative or expected polarity. Further, the illustrative embodiment does not have to consider, e.g., timing for applying a voltage to the charge brush 12M, so that a voltage can be continuously applied to the charge brush 12M even when an image is being formed. In addition, part of the toner grains of opposite polarity is again charged to expected polarity before it passes through the charging zone. This reduces the amount of toner grains to deposit on the charge roller 15M for thereby reducing a load on the charging device.

The toner grains of negative polarity, contained in the residual toner grains moved away from the charge brush 12M, are passed through the charging zone and then temporarily held by the elastic blade 81. The residual toner grains of opposite polarity not inverted in polarity by the charge brush 12M deposit on the charge roller 15M and are temporarily held by the charge injection plate 54 and again charged to negative polarity when the optical writing unit 2 is not forming a latent image. On the other hand, the toner grains temporarily held by the elastic blade 81 are conveyed to the developing zone when the elastic blade 82 is released from the drum 11M, and then collected in the developing unit by the developing roller.

If desired, an AC-biased DC voltage may be applied to the charge brush 12M in order to uniform the amount of charge of the toner grains after image transfer. It is therefore possible to reduce the amount of toner grains to undesirably deposit on the charge roller 15M and therefore to maintain the charging device stable at all times. Also, the charge injection plate or charge injecting means 54 may be omitted, in which case the charge brush 12M serves as charge injecting means.

As stated above, in the illustrative embodiment, residual toner grains, left on the drum 11M without being electrostatically transferred to the paper sheet 100 at the image transfer nip, are temporarily, mechanically held by the elastic blade or toner holding member or means 81 before reaching the latent image forming zone. Such mechanical holding means is capable of holding both of toner grains of expected polarity and toner grains of opposite polarity. The residual toner grains are returned to the surface of the drum 11M at such timing that the optical writing unit 2 is not forming a latent image when the toner grains pass through the latent image forming zone. This prevents the residual toner grains from depositing on the drum 11M whose surface is passing through the latent image forming zone when a latent image is being formed. Consequently, hidden or non-exposed portions ascribable to the residual toner grains and therefore white spots or similar image defects are obviated, so that high image quality is insured.

The charge roller 15M plays the role of temporary toner holding means on which the toner grains of opposite charge are caused to deposit. The charge injection plate or charge injecting means 54 is associated with the charge roller 15M.

The charge injection plate 54 injects a charge in the toner grains of opposite polarity held by the charge roller 15M, inverting the opposite polarity to the expected polarity. By temporarily holding the toner grains of opposite polarity and then injecting a charge therein, as stated above, it is possible to surely invert the polarity of the residual toner grains to the expected polarity. It follows that the entire toner grains conveyed to the developing region are charged to the expected polarity when brought to the developing zone and can therefore be surely collected by the developing unit.

The charge injection plate 54 provided on the charge roller 15M removes the residual toner grains from the charge roller 15M, thereby preventing toner grains of opposite polarity from depositing on the charge roller 15M and lowering the charging ability. In addition, it is not necessary to use, e.g., a waste toner tank customarily included in a cleaning device, which cleans the charge roller 15M, for storing residual toner grains collected from the charge roller 15M. This contributes a great deal to the size reduction of the printer.

Moreover, the elastic blade or toner holding means 81 is positioned downstream of the charge injection plate 54 in the direction of rotation of the drum 11M, so that all residual toner grains held by the elastic blade 81 are charged to expected polarity. Because toner grains of expected charge adhere to the drum 11M with a weaker force than toner grains of opposite polarity, it is possible to surely hold the residual toner grains without strongly pressing the elastic blade 81 against the drum 11. Consequently, stress to act on the drum 11M and elastic blade 81 is reduced, so that the durability of the blade 81 and drum 11M is enhanced. In addition, conditions required of the elastic blade 81 can be easily set.

Fourth Embodiment

While in the first, second and third embodiments toner holding means for temporarily holding the residual toner grains left on the drum 11M is provided on the surface of the drum 11M, the charge roller 15M may play the role of toner holding means also. A fourth embodiment to be described hereinafter is configured such that the residual toner grains are held on the surface of the charge roller 15M. Parts and elements identical with those of the first embodiment will not be described in order to avoid redundancy.

Figure 15:
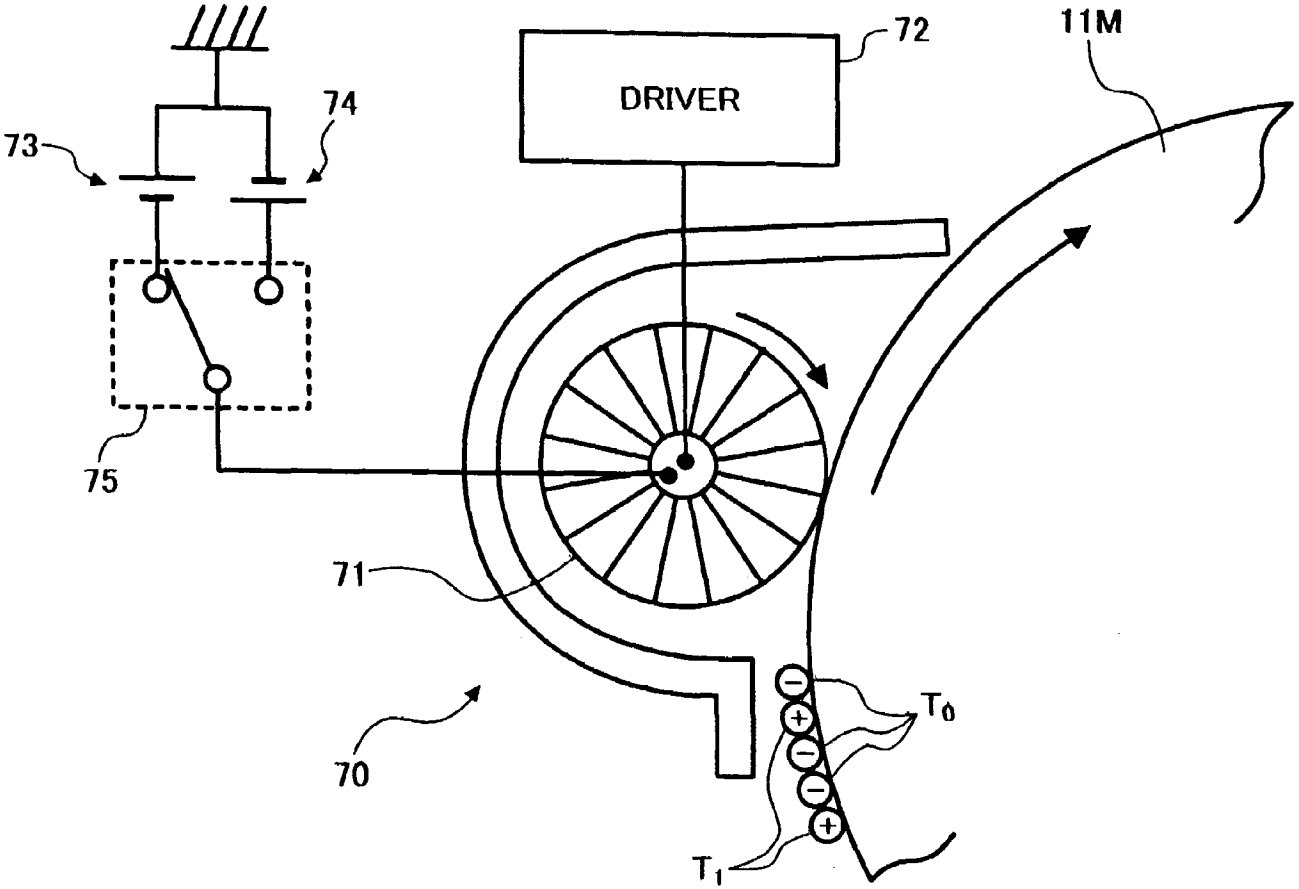
FIG. 15 shows a polarity control device representative of a fourth embodiment of the present invention.

As shown in FIG. 15, to prevent the toner grains from passing through the charging zone, a polarity control device 70 regulates the polarity of the entire residual toner grains to the polarity of the charge bias (negative), i.e., positive polarity before the residual toner grains reach the charging zone. That is, the polarity control device 70 uniforms the entire residual toner grains to opposite polarity. Consequently, the entire residual toner grains are caused to electrostatically adhere to the charge roller 15M away from the surface of the drum 11M. Subsequently, the residual toner grains thus held by the charge roller 15M are entirely charged to positive or negative polarity by a blade 76, see FIGS. 16A and 16B, applied with a bias and then returned to the surface of the drum 11M at preselected timing. Such a construction and operation unique to the fourth embodiment will be described more specifically hereinafter.

First, a polarity control step for controlling the polarity of the entire residual toner grains left on the drum 11M to positive polarity will be described.

Referring again to FIG. 15, the drum 11M, facing the polarity control device 70, is formed of an organic photoconductor and provided with an outside diameter of 30 mm. The polarity control device 70 includes a polarity control roller or contact member 71 rotatable in contact with the surface of the drum 11M. The polarity control roller 71 is provided with resistance low enough to easily invert the polarity of the toner grains of expected polarity brought into contact therewith to the opposite polarity. This enhances the toner holding ability of the charge roller 15M to thereby reduce the frequency at which the residual toner grains pass through the charging zone, as will be described more specifically later.

The polarity control roller 71 is provided with hardness low enough to increase the area over which the residual toner grains and polarity control roller 71 contact each other, so that the polarity of toner grains charged to positive polarity, which will be described later, can be stably inverted. In the illustrative embodiment, the polarity control roller 71 is provided with resistance of $10^8$ Ω·cm or below and hardness of between 25 degrees and 70 degrees in Askar C scale.

When the hardness of the polarity control roller 71 lies in the above range, the polarity control roller 71 should preferably be pressed against the surface of the drum 11M by a force of between 0.1 g/mm$^2$ and 30 g/mm$^2$. In this case, when the roller hardness is Askar C 30 degrees or below, the residual toner on the drum 11M and the surface of the polarity control roller 71 may be caused to surely contact each other by a pressure as low as 0.1 g/mm$^2$ or above, but 3 g/mm$^2$ or below. This insures stable inversion of the polarity of the residual toner grains of expected polarity and, in addition, protects the surface of the drum 11M from wear because of the low pressure. Even when the roller hardness is higher than Askar C 30 degrees, but lower than 60 degrees, the pressure is selected to be between 1.0 g/mm$^2$ and 10 g/mm$^2$. This is also successful to insure positive, stable contact of the residual toner grains of expected polarity on the drum 11M and the polarity control roller 71 and insure stable inversion of the polarity of the residual toner grains of expected polarity. Further, even when the Askar C hardness is between 60 degrees and 70 degrees, the pressure is selected to be between 5 g/mm$^2$ and 30 g/mm$^2$. This is also successful to achieve the above advantages. It is preferable to coat the polarity control roller 71 with a material that allows toner to easily part therefrom so as to prevent toner from adhering to the polarity control roller 71.

As shown in FIG. 15, a driver or drive means 72 causes the polarity control roller 71 to rotate in a direction indicated by an arrow. A first and a second power supply 73 and 74, respectively, selectively apply a bias to the polarity control roller 71. More specifically, a switch 75 is connected between the power supplies 73 and 74 and the polarity control roller 71 and operated to connect either one of the power supplies 73 and 74 to the polarity control roller 71 by a control unit, not shown, included in the printer. In the illustrative embodiment, the first and second power supplies 74 and 75 and switch 75 constitute bias applying means in combination. The first power supply 73 applies a cleaning bias that deposits a potential of −200 V on the surface of the polarity control roller 71 while the second power supply 74 applies a charge injection bias that deposits a potential of +700 V on the above surface. While the power supplies 73 and 74 are implemented as DC power supplies in the illustrative embodiment, they may alternatively be implemented as AC-biased DC power supplies.

The first power supply 73 is connected to the polarity control roller 71 before part of the surface of the drum 11M on which the residual toner is deposited (roller contact zone hereinafter) contacts the polarity control roller 71, so that a charge injection bias that deposits +700 V on the surface of the polarity control roller 71 is applied to the polarity control roller 71. When the polarity control roller 71 with such a bias contacts the surface of the drum 11M, the toner grains $T_0$ of expected polarity, contained in the residual toner grains left on the drum 11M, are inverted in polarity. The toner grains with the polarity thus inverted are conveyed via the roller contact zone by the drum 11M.

More specifically, the surface of the drum 11M is uniformly charged to −500 V by the charge roller 15M and then scanned by the optical writing unit 2 to form a latent image whose potential is about −50 V. Subsequently, when a developing step for depositing toner grains on the latent image and an image transferring step are sequentially executed in this order, the potential of the latent image portion becomes further closer to 0 V. Most of the residual toner grains are left on the surface portion of the drum 11M where the latent image existed. In this condition, the toner grains $T_0$ of expected or negative polarity left on the above surface portion of the drum 11M are subjected to, in the roller contact zone, charge injection from the polarity control roller 71 applied with the bias of +700 V.

The potential of −500 Von the background around the latent image is also shifted toward the 0 V side by the image transfer. Although some residual toner grains may deposit on the background also, the toner grains $T_0$ of expected or negative polarity on the background are also subjected to charge injection on contacting the polarity control roller 71 in the roller contact zone. When the toner grains $T_0$ of expected polarity are thus inverted to toner grains $T_0$ of positive polarity, the toner grains $T_0$ of expected polarity are electrostatically biased toward the drum 11M in the roller contact zone. Consequently, among the residual toner grains left on the surface of the drum 11M, the toner grains $T_0$ of expected polarity are inverted in polarity in the roller contact zone and therefore conveyed by the drum 11M via the roller contact zone.

On the other hand, among the residual toner grains, the toner grains $T_1$ of opposite or positive polarity are electrostatically biased toward the drum 11M in the roller contact zone. As a result, the toner grains $T_1$ remain on the surface of the drum 11M without being subjected to charge injection from the polarity control roller 71.

In this manner, all residual toner grains left on the drum 11M are uniformed to positive polarity in the roller contact zone and therefore passed through the roller contact zone by the drum 11M.

The polarity control roller 71 is driven by the driver 72 such that its surface moves in the same direction as the surface of the drum 11M at the roller contact zone. This allows the surface of the polarity control roller 71 and the residual toner on the drum 11M to contact each other over a long period of time and can therefore surely invert the polarity of the toner grains $T_0$ of expected polarity left on the drum 11M. If the surface of the polarity control roller 71 are implemented as a brush, then it is likely that the tips of brush chains spring up and cause the residual toner grains to fly about at the moment when they leave the surface of the drum 11M. When the surface of the polarity control roller 71 moves in the same direction as the surface of the drum 11M as in the illustrative embodiment, it is likely that the residual toner grains are caused to fly toward the downstream side over the roller contact zone in the direction of movement of the drum surface, contaminating the inside of the printer. To solve this problem, the polarity control roller 71 of the illustrative embodiment is provided with a smooth surface.

Figure 16B:
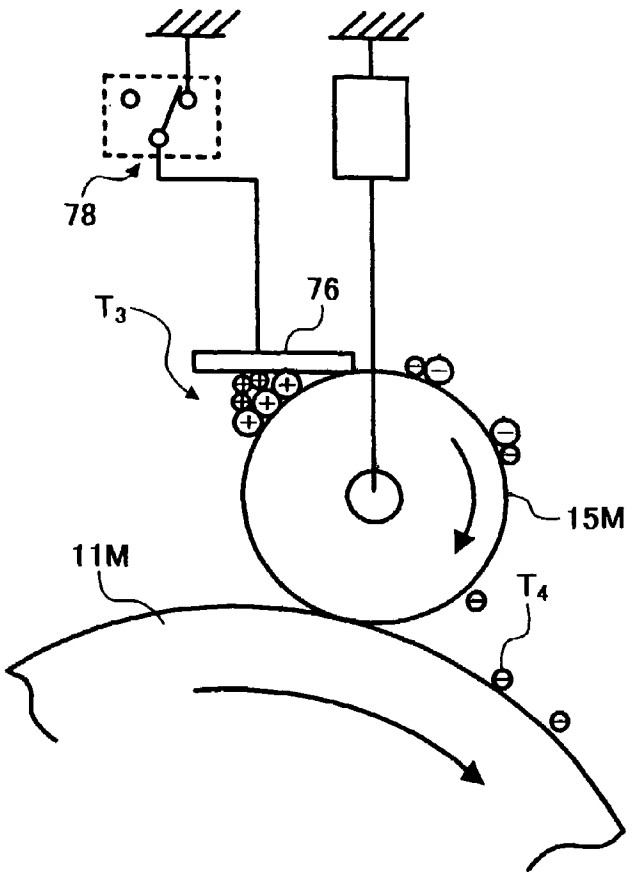
FIG. 16B shows the charge roller in a toner collecting condition.
Figure 16A:
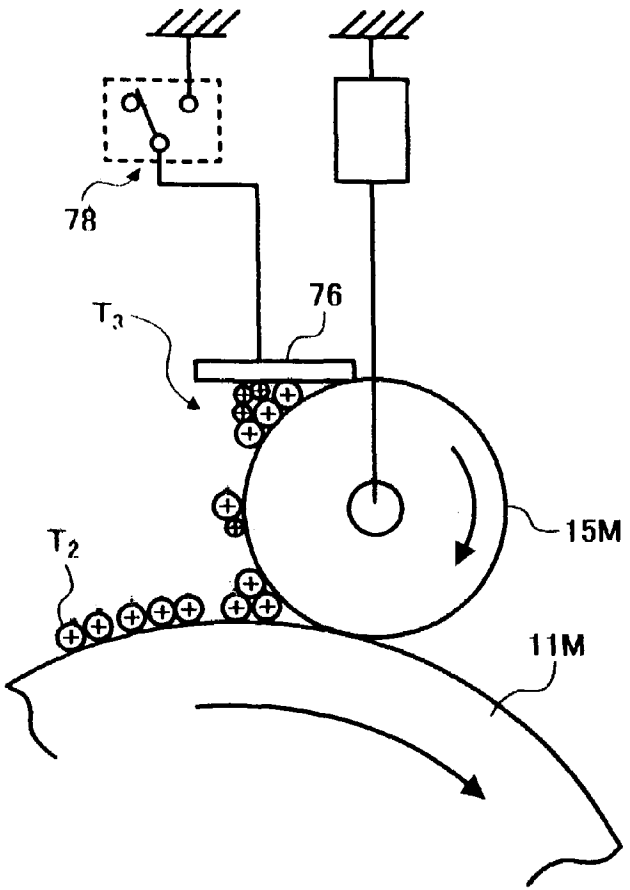
FIG. 16A shows a charge roller included in the fourth embodiment in a developing condition.

The timing at which residual toner grains $T_2$, uniformed to positive polarity by the polarity control roller 71, are temporarily held by the charge roller 15M and then returned to the drum 11M will be described more specifically hereinafter. FIG. 16A shows a condition wherein the residual toner grains are temporarily held by the charge roller 15M while FIG. 16B shows a condition wherein they are released from the charge roller 15M.

The toner grains $T_2$ inverted in polarity by the polarity control roller 71 are temporarily held by the charge roller 15M in the charging zone. Subsequently, the toner grains, labeled $T_3$, held by the charge roller 15M are released to the surface of the drum 11M at preselected release timing. In the illustrative embodiment, the toner grains $T_3$ are inverted in polarity from positive to negative and then released to the drum 11M when the printer is not forming an image, i.e., between consecutive image forming cycles. More specifically, the toner grains $T_2$ uniformed in polarity during one image forming cycle are temporarily held by the charge roller 15M in the charging zone. Subsequently, during the next image forming cycle, the toner grains $T_3$ are released to the surface of the drum 11M before part of the drum surface to be charged by the charge roller 15M reaches the charging zone. By releasing the toner grains $T_3$ at such timing, it is possible to collect them without influencing the next image forming cycle. When the image forming cycle is repeated, the toner grains $T_3$ accumulated on the charge roller 15M may be released at the end of the last image forming cycle, if desired. This prevents a period of time to the end of the image forming operation from being extended due to the collection of the toner grains $T_3$, which will be described later.

The temporary holding step will be described more specifically hereinafter. Residual potential left by the previous image forming cycle exists on the surface portion of the drum 11M on which the toner grains $T_2$, uniformed to positive polarity by the polarity control roller 71, are deposited. In the illustrative embodiment, the residual potential is about −50 V. However, in the illustrative embodiment, the second power supply 74 is constantly connected to the polarity control roller 71 during image formation, so that the surface potential of the polarity control roller 71 is maintained at +700 V during image formation. Therefore, the potential of the background not exposed is also discharged to about −50 V, which is the residual potential mentioned above. As a result, the charge potential of the surface portion of the drum 11M on which the toner grains $T_2$ are deposited is uniformed to about −50 V. It follows that the above portion of the drum 11M reaches the charging zone, an electrostatic force acts on the toner grains $T_2$, which have been uniformed to positive polarity, toward the charge roller 15M whose surface potential is about −500 V. Consequently, the toner grains $T_2$ of opposite polarity moved away from the roller contact zone of the polarity control roller 71 electrostatically adhere to the surface of the charge roller 15M and are temporarily held thereby.

As shown in FIG. 16A, the toner grains $T_3$ thus temporarily held by the charge roller 15M gather in a space (gathering space hereinafter) between the surface of the charge roller 15M and a bias applying blade 76 held in contact with the charge roller 15M. The bias applying blade 76 is formed of stainless steel or similar metal and connected to a switch 78 at one end. As shown in FIG. 16A, to cause the toner grains $T_3$ to gather in the gathering space, the switch 78 is held in an electrically floating state so as to make the potential of the bias applying blade 76 equal to the potential of the charge roller 15M. Therefore, an electric field is not formed in the gathering space.

Further, the bias applying blade 76 is pressed against the charge roller 75M in order to limit the amount of toner grains $T_3$ to pass. In the illustrative embodiment, the pressure of the bias applying blade 76 is selected such that the amount of toner grains $T_3$ to get through between the charge roller 15M and the bias applying blade 76 is 0.1 mg or below, preferably 0.05 mg or below, for a unit square centimeter. In this condition, even if the amount of toner grains $T_3$ deposited on the charge roller 15M may increase, the amount of toner grains to exist on the surface portion of the charge roller 15M that faces the charging zone can be reduced. This sufficiently reduces irregular or similar defective charging.

Next, the releasing step will be described in more detail. As shown in FIG. 16B, the switch 78 is connected to ground in synchronism with the release timing stated above. Then, the potential of the bias applying blade 76 becomes 0 V with the result that a potential difference occurs between the bias applying blade 76 and the charge roller 15M whose surface potential is about −500 V. As a result, charge injection from the charge roller 15M to the toner grains $T_3$ begins, charging the toner grains $T_3$ to negative or expected polarity. The toner grains $T_3$, passed through the gathering space, are conveyed by the charge roller 15M to the charging zone. In the charging zone, the toner grains $T_3$ of negative polarity are subjected to an electrostatic force directed toward the surface of the drum 11M and consequently deposit on the drum 11M. In this manner, the toner grains $T_3$ temporarily held by the charge roller 15M are released to the surface of the drum 11M.

The residual toner grains thus released from the charge roller 15M are collected in the developing zone by the magnet brush formed on the sleeve 22M as in the first embodiment.

Experiments showed that more toner grains passed through the contact portion between the charge roller 15M and the bias applying blade 76 in the releasing step than in the temporary holding step. Such a phenomenon is desirable in that the amount of toner grains present on the surface portion of the charge roller 15M that faces the charging zone decreases and in that a period of time necessary for the releasing step to complete decreases. The phenomenon is presumably derived from the influence of the potential difference between the charge roller 15M and the bias applying blade 76.

As stated above, in the illustrative embodiment, the polarity control device 70 plays the role of residual toner polarity control means for charging the residual toner grains $T_0$ and $T_1$, which are left on the drum 11M after image transfer, to positive polarity opposite to negative or expected polarity. With the polarity control device 70, it is possible to uniform the entire residual toner grains to positive polarity and therefore cause the entire residual toner grains $T_2$ to be held by the charge roller 15M. This allows the toner grains $T_2$ to be removed from the surface of the drum 11M before they are brought to the latent image forming zone assigned to the optical writing unit 2. Consequently, there can be obviated an occurrence that the toner grains $T_2$ obstruct the formation of a latent image in the latent image forming zone, thereby insuring high-quality images free from local omission.

Further, the surface of the drum 11M can be sufficiently cleaned without resorting to a strong removing ability available with, e.g., a conventional cleaning blade. It follows that load torque to act on a drive source assigned to the drum 11M can be noticeably reduced, compared to a configuration wherein a cleaning blade is held in contact with the surface of the drum 11M. This allows a small-size drive source to be used and reduces banding or similar undesirable phenomenon, insuring high-quality images at all times.

In the illustrative embodiment, the bias applying blade 76 serves as charge injecting means for depositing on the residual toner grains $T_3$ held on the charge roller 15M a charge of the same polarity as the expected or negative polarity to thereby uniform the residual toner grains to negative polarity. Further, an arrangement is made such that the toner grains $T_4$, uniformed to the same polarity as the expected or negative polarity by the bias applying blade 76, are returned to the surface of the drum 11M at such timing that the toner grains returned from the charge roller 15M to the drum 11M do not obstruct the formation of a latent image by the optical writing unit 2. This allows the toner grains $T_3$ controlled to the opposite or positive polarity by the polarity control device 70 to be again charged to the expected polarity and then released to the drum 11M. Consequently, adequate development can be effected even when the toner grains $T_3$ are returned to the expected polarity and then returned to the drum 11M so as to contribute to development. In addition, because all the toner grains $T_4$ returned to the drum 11M are of the expected polarity, they can be adequately collected from the drum 11M by an electrostatic force.

The polarity control roller 71 is driven such that its surface moves in the same direction as the surface of the drum 11M, as seen at the position where the former contacts the latter. In addition, the second power supply or bias applying means 74 applies a bias of opposite or positive polarity to the polarity control roller 71. By so driving the polarity control roller 71, it is possible to promote close contact of the polarity control roller 71 with the residual toner grains $T_0$ and $T_1$ left on the surface of the drum 11M more easily than by driving it in the direction counter to the drum surface. It is therefore possible to increase the charge injection efficiency in, among the residual toner grains, the toner grains $T_0$ of expected polarity for thereby stably uniforming all residual toner grains to the positive or opposite polarity. This allows the toner grains $T_2$ to surely deposit on the charge roller 15M.

In the polarity control device 70, the surface of the polarity control roller or contact member 71 moves in contact with the surface of the drum 11M. Further, the bias applying means selectively applies a cleaning bias of expected or negative polarity or a charge injection bias of opposite or positive polarity to the polarity control roller 71. The bias applying means is made up of the first power supply 73, second power supply 74 and switch 75. With this configuration, it is possible to uniform all residual toner grains to positive polarity and cause them to deposit on the charge roller 15M when the charge injection bias is applied. On the other hand, with the cleaning bias, it is possible to increase the cleaning efficiency when a great amount of unnecessary toner grains exist on the surface of the drum 11M, e.g., in the event of a jam. Also, when toner grains with a defective charging characteristic and charged to negative polarity are deposited on the polarity control roller 71, the cleaning bias causes such toner grains to be released to the drum 11M.

In summary, in accordance with the present invention, when developing means collects residual toner grains left on an image carrier after image transfer, a DC voltage is applied to the image carrier and a developer carrier in such a direction that the toner grains move from the image carrier toward the developer carrier. In this condition, the residual toner grains are electrostatically attracted by a magnetic carrier present on the surface of the developer carrier and can therefore be easily scraped off from the surface of the image carrier by a magnetic brush formed by the magnetic carrier. Further, the DC voltage generates a bias only in one direction, unlike an AC voltage, and therefore makes it difficult for the toner grains scarped off to again deposit on the image carrier.

Moreover, the developer carrier generates, at a position where it faces the image carrier, a magnetic field exerting a magnetic force of 100 mT or above in the direction normal to the surface of the developer carrier. Such a magnetic field makes the magnetic brush hard to thereby increase the rubbing force of the magnetic brush when it contacts the image carrier, so that the residual toner grains can be easily scraped off from the surface of the image carrier.

Various modifications will become possible for those skilled in the art after receiving the teachings of the present disclosure without departing from the scope thereof.

The invention claimed is:

1. An image forming apparatus comprising:

an image carrier;

charging means for uniformly charging a surface of said image carrier;

latent image forming means for forming a latent image on the surface of said image carrier uniformly charged by said charging means;

developing means for developing the latent image to thereby produce a corresponding toner image, said developing means comprising stationary magnetic field generating means, which is disposed thereinside, and rotatable with a two-ingredient type developer made up of magnetic carrier grains and toner grains deposited on a surface thereof; and image transferring means for transferring the toner image from said image carrier to an image transfer medium;

wherein said developing means bifunctions as cleaning means for collecting residual toner grains left on said image carrier after transfer of the toner image to the image transfer medium, in the event of collection of the residual toner grains, a DC voltage is applied to said image carrier and a developer carrier to thereby form an electric field in a direction in which the residual toner grains move from said image carrier toward said developer carrier, and said magnetic field generating means generates, at a position where said developer carrier faces said image carrier, a magnetic field whose magnetic force in a direction normal to the surface of said developer carrier is between 100 mT and 200 mT.

2. The apparatus as claimed in claim 1, further comprising:

toner holding means contacting the surface of said image carrier at a position downstream of an image transfer position where said image transferring means performs image transfer in a direction in which said surface of said image carrier moves, but upstream of a position where said surface of said image carrier faces said charging means in said direction, said toner holding means temporarily holding the residual toner grains to thereby prevent said residual toner grains from moving to a downstream side in said direction together with said surface of said image carrier; and control means for selectively causing said toner holding means to hold or release the residual toner grains such that said residual toner grains held by said toner holding means are released at a preselected timing and again moved toward the downstream side together with the surface of said image carrier.

3. The apparatus as claimed in claim 2, wherein said toner holding means comprises a toner holding member held in contact with said image carrier for mechanically, temporarily holding the residual toner grains.

4. The apparatus as claimed in claim 3, wherein said toner holding member is movable into contact with said image carrier during formation of the latent image or out of contact with said image carrier during collection of the residual toner grains.

5. The apparatus as claimed in claim 2, wherein said toner holding means comprises a rotary member configured to support the magnetic carrier grains on a surface thereof in a form of a magnetic brush with magnetic field generating means disposed in said rotary member, said magnetic brush being held in rubbing contact with the surface of said image carrier for temporarily holding the residual toner grains.

6. The apparatus as claimed in claim 2, further comprising an auxiliary charging member located at a position downstream of the image transferring position, but upstream of a latent image forming position, for uniformly charging the residual toner grains to a same polarity as uniform charging.

7. The apparatus as claimed in claim 2, further comprising electric field forming means for forming an electric field between said image carrier and said developer carrier, wherein assuming that an amount of charge deposited on the toner grains is Q, that a voltage applied to said electric field forming means is V1 during toner collection or V2 during development, and that a voltage applied to a developing member of said developer carrier is Vb, then there are satisfied relations:

when $Q<0$, $(V1-Vb)<0$ and $(V2-Vb)>0$ and when $Q>0$, $(V1-Vb)>0$ and $(V2-Vb)<0$.

8. The apparatus as claimed in claim 7, wherein said electric field forming means is positioned between a doctor configured to regulate a height of carrier chains formed on said developer carrier and a developing zone where said developer carrier and said image carrier are closest to each other.

9. The apparatus as claimed in claim 8, wherein a shortest distance between said developer carrier and said image carrier is between 0.2 mm and 0.5 mm.

10. The apparatus as claimed in claim 7, wherein said electric field forming means applies the voltage V1 or the voltage V2 to a doctor.

11. The apparatus as claimed in claim 10, wherein a shortest distance between said developer carrier and said image carrier is between 0.2 mm and 0.5 mm.

12. The apparatus as claimed in claim 2, wherein said magnetic field generating means comprises a main-pole magnet disposed in said developer carrier variable in angle such that a magnetic pole of said main-pole magnet is closest to said image carrier during development or is directed toward an upstream side in the direction of movement of the surface of said image carrier.

13. The apparatus as claimed in claim 2, wherein said developer carrier and said image carrier are rotated in opposite directions to each other with surfaces thereof moving in a same direction at a facing position, and assuming that the surface of said developer carrier and the surface of said image carrier move at speeds of Vs and Vp, respectively, then a ratio Vs/Vp is 2 or above.

14. The apparatus as claimed in claim 2, wherein the magnetic carrier grains have a grain size as small as 40 μm or below.

15. The apparatus as claimed in claim 1, further comprising:

toner holding means contacting the surface of said image carrier at a position downstream of a position where said image carrier faces said charging means in a direction in which said surface of said image carrier moves, but upstream of a latent image forming position in said direction, for temporarily holding the residual toner grains; and control means for selectively causing said toner holding means to hold or release the residual toner grains such that said residual toner grains held by said toner holding means are released at a preselected timing and again returned to the surface of said image carrier.

16. The apparatus as claimed in claim 15, wherein a charging member of said charging means comprises a charge roller contacting or adjoining the surface of said image carrier, said apparatus further comprising a charge injecting member positioned on said charging member for injecting a charge of a same polarity as the uniform charging in, among the residual toner grains left on said surface of said image carrier, the residual toner grains charged to a polarity opposite to the polarity of the uniform charging.

17. The apparatus as claimed in claim 15, further comprising an auxiliary charging member positioned downstream of an image transfer position assigned to said image transferring means in the direction of movement of the surface of said image carrier, but upstream of a latent image forming position in said direction, for charging the residual toner grains to a same polarity as uniform charging.

18. The apparatus as claimed in claim 15, further comprising electric field forming means for forming an electric field between said image carrier and said developer carrier, wherein assuming that an amount of charge deposited on the toner grains is Q, that a voltage applied to said electric field forming means is V1 during toner collection or V2 during development, and that a voltage applied to a developing member of said developer carrier is Vb, then there are satisfied relations:

when $Q<0$, $(V1-Vb)<0$ and $(V2-Vb)>0$ and when $Q>0$, $(V1-Vb)>0$ and $(V2-Vb)<0$.

19. The apparatus as claimed in claim 18, wherein said electric field forming means is positioned between a doctor configured to regulate a height of carrier chains formed on said developer carrier and a developing zone where said developer carrier and said image carrier are closest to each other.

20. The apparatus as claimed in claim 19, wherein a shortest distance between said developer carrier and said image carrier is between 0.2 mm and 0.5 mm.

21. The apparatus as claimed in claim 18, wherein said electric field forming means applies the voltage V1 or the voltage V2 to a doctor.

22. The apparatus as claimed in claim 21, wherein a shortest distance between said developer carrier and said image carrier is between 0.2 mm and 0.5 mm.

23. The apparatus as claimed in claim 15, wherein said magnetic field generating means comprises a main-pole magnet disposed in said developer carrier variable in angle such that a magnetic pole of said main-pole magnet is closest to said image carrier during development or is directed toward an upstream side in the direction of movement of the surface of said image carrier.

24. The apparatus as claimed in claim 15, wherein said developer carrier and said image carrier are rotated in opposite directions to each other with surfaces thereof moving in a same direction at a facing position, and assuming that the surface of said developer carrier and the surface of said image carrier move at speeds of Vs and Vp, respectively, then a ratio Vs/Vp is 2 or above.

25. The apparatus as claimed in claim 15, wherein the magnetic carrier grains have a grain size as small as 40 μm or below.

26. The apparatus as claimed in claim 1, wherein said charging means comprises a charge roller contacting or adjoining the surface of said image carrier, said apparatus further comprising polarity control means positioned upstream of an image transferring position where said image transferring means performs image transfer in a direction in which the surface of said image carrier moves, but downstream of a position where said surface of said image carrier faces said charging means in said direction, for charging the residual toner grains to a polarity opposite to a polarity of uniform charging to thereby temporarily hold said residual toner grains of an opposite polarity on said charge roller.

27. The apparatus as claimed in claim 26, further comprising charge injecting means for injecting a charge of a same polarity as the uniform charging in the residual toner grains held by the surface of said charge roller for thereby uniforming said residual toner grains to the same polarity as the uniform charging, wherein said residual toner grains of the same polarity as the uniform charging are returned to the surface of said image carrier at such a timing that said residual toner grains returned to said surface of said image carrier do not obstruct formation of a latent image by said latent image forming means.

28. The apparatus as claimed in claim 26, further comprising electric field forming means for forming an electric field between said image carrier and said developer carrier, wherein assuming that an amount of charge deposited on the toner grains is Q, that a voltage applied to said electric field forming means is V1 during toner collection or V2 during development, and that a voltage applied to a developing member of said developer carrier is Vb, then there are satisfied relations:

when $Q<0$, $(V1-Vb)<0$ and $(V2-Vb)>0$ and when $Q>0$, $(V1-Vb)>0$ and $(V2-Vb)<0$.

29. The apparatus as claimed in claim 28, wherein said electric field forming means is positioned between a doctor configured to regulate a height of carrier chains formed on said developer carrier and a developing zone where said developer carrier and said image carrier are closest to each other.

30. The apparatus as claimed in claim 29, wherein a shortest distance between said developer carrier and said image carrier is between 0.2 mm and 0.5 mm.

31. The apparatus as claimed in claim 28, wherein said electric field forming means applies the voltage V1 or the voltage V2 to a doctor.

32. The apparatus as claimed in claim 31, wherein a shortest distance between said developer carrier and said image carrier is between 0.2 mm and 0.5 mm.

33. The apparatus as claimed in claim 26, wherein said magnetic field generating means comprises a main-pole magnet disposed in said developer carrier variable in angle such that a magnetic pole of said main-pole magnet is closest to said image carrier during development or is directed toward an upstream side in the direction of movement of the surface of said image carrier.

34. The apparatus as claimed in claim 26, wherein said developer carrier and said image carrier are rotated in opposite directions to each other with surfaces thereof moving in a same direction at a facing position, and assuming that the surface of said developer carrier and the surface of said image carrier move at speeds of Vs and Vp, respectively, then a ratio Vs/Vp is 2 or above.

35. The apparatus as claimed in claim 26, wherein the magnetic carrier grains have a grain size as small as 40 μm or below.

36. The apparatus as claimed in claim 1, further comprising electric field forming means for forming an electric field between said image carrier and said developer carrier, wherein assuming that an amount of charge deposited on the toner grains is Q, that a voltage applied to said electric field forming means is V1 during toner collection or V2 during development, and that a voltage applied to a developing member of said developer carrier is Vb, then there are satisfied relations:

when $Q<0$, $(V1-Vb)<0$ and $(V2-Vb)>0$ and when $Q>0$, $(V1-Vb)>0$ and $(V2-Vb)<0$.

37. The apparatus as claimed in claim 36, wherein said electric field forming means is positioned between a doctor configured to regulate a height of carrier chains formed on said developer carrier and a developing zone where said developer carrier and said image carrier are closest to each other.

38. The apparatus as claimed in claim 37, wherein a shortest distance between said developer carrier and said image carrier is between 0.2 mm and 0.5 mm.

39. The apparatus as claimed in claim 37, wherein a shortest distance between said image carrier and said doctor is between 0.2 mm and 0.5 mm.

40. The apparatus as claimed in claim 36, wherein said electric field forming means applies the voltage V1 or the voltage V2 to a doctor.

41. The apparatus as claimed in claim 40, wherein a shortest distance between said developer carrier and said image carrier is between 0.2 mm and 0.5 mm.

42. The apparatus as claimed in claim 40, wherein a shortest distance between said image carrier and said doctor is between 0.2 mm and 0.5 mm.

43. The apparatus as claimed in claim 36, wherein said magnetic field generating means comprises a main-pole magnet disposed in said developer carrier variable in angle such that a magnetic pole of said main-pole magnet is closest to said image carrier during development or is directed toward an upstream side in the direction of movement of the surface of said image carrier.

44. The apparatus as claimed in claim 36, wherein said developer carrier and said image carrier are rotated in opposite directions to each other with surfaces thereof moving in a same direction at a facing position, and assuming that the surface of said developer carrier and the surface of said image carrier move at speeds of Vs and Vp, respectively, then a ratio Vs/Vp is 2 or above.

45. The apparatus as claimed in claim 36, wherein the magnetic carrier grains have a grain size as small as 40 μm or below.

46. The apparatus as claimed in claim 1, wherein said magnetic field generating means comprises a main-pole magnet disposed in said developer carrier variable in angle such that a magnetic pole of said main-pole magnet is closest to said image carrier during development or is directed toward an upstream side in the direction of movement of the surface of said image carrier.

47. The apparatus as claimed in claim 46, wherein said developer carrier and said image carrier are rotated in opposite directions to each other with surfaces thereof moving in a same direction at a facing position, and assuming that the surface of said developer carrier and the surface of said image carrier move at speeds of Vs and Vp, respectively, then a ratio Vs/Vp is 2 or above.

48. The apparatus as claimed in claim 46, wherein the magnetic carrier grains have a grain size as small as 40 μm or below.

49. The apparatus as claimed in claim 1, wherein said developer carrier and said image carrier are rotated in opposite directions to each other with surfaces thereof moving in a same direction at a facing position, and assuming that the surface of said developer carrier and the surface of said image carrier move at speeds of Vs and Vp, respectively, then a ratio Vs/Vp is 2 or above.

50. The apparatus as claimed in claim 49, wherein the magnetic carrier grains have a grain size as small as 40 μm or below.

51. The apparatus as claimed in claim 1, wherein the magnetic carrier grains have a grain size as small as 40 μm or below.

52. In a process cartridge removably mounted to a body of an image forming apparatus, said image forming apparatus comprising:

an image carrier;

charging means for uniformly charging a surface of said image carrier;

latent image forming means for forming a latent image on the surface of said image carrier uniformly charged by said charging means;

developing means for developing the latent image to thereby produce a corresponding toner image, said developing means comprising stationary magnetic field generating means, which is disposed thereinside, and rotatable with a two-ingredient type developer made up of magnetic carrier grains and toner grains deposited on a surface thereof; and image transferring means for transferring the toner image from said image carrier to an image transfer medium;

wherein said developing means bifunctions as cleaning means for collecting residual toner grains left on said image carrier after transfer of the toner image to the image transfer medium, in the event of collection of the residual toner grains, a DC voltage is applied to said image carrier and a developer carrier to thereby form an electric field in a direction in which the residual toner grains move from said image carrier toward said developer carrier, said magnetic field generating means generates, at a position where said developer carrier faces said image carrier, a magnetic field whose magnetic field in a direction normal to the surface of said developer carrier is between 100 mT and 200 mT, and at least one of said developing means and said charging means and said image carrier are constructed integrally with each other.

53. In a cleaning system included in an image forming apparatus, which comprises an image carrier, charging means for uniformly charging a surface of said image carrier, latent image forming means for forming a latent image on said surface of said image carrier uniformly charged by said charging means, developing means for developing said latent image to thereby produce a corresponding toner image with a developer carrier, which comprises stationary magnetic field forming means disposed thereinside and is rotatable with a two-ingredient type developer made up of magnetic carrier grains and toner grains deposited thereon, and image transferring means for transferring said toner image from said image carrier to an image transfer medium, said developing means bifunctioning as cleaning means for collecting residual toner grains left on said image carrier after transfer of said toner image, a DC voltage is applied to said image carrier and said developer carrier to form an electric field in such a direction that said residual toner grains move from said image carrier toward said developer carrier, and said developer carrier comprises a magnetic field generating means that generates a magnetic force of between 100 mT and 200 mT in a direction normal to said surface of said developer carrier at a position where said developer carrier faces said image carrier.

* * * * *

UNITED STATES PATENT AND TRADEMARK OFFICE

CERTIFICATE OF CORRECTION

PATENT NO. : 7,315,711 B2
APPLICATION NO. : 11/150299
DATED : January 1, 2008
INVENTOR(S) : Osamu Ariizumi et al.

It is certified that error appears in the above-identified patent and that said Letters Patent is hereby corrected as shown below:

On the title page, Item (75), the Inventors information is incorrect. Item (75) should read as follows:

-- (75) Inventors: Osamu Ariizumi, Kanagawa (JP); Masahide Yamashita, Tokyo (JP); Koji Suzuki, Kanagawa (JP); Yasushi Koichi, Kanagawa (JP); Shigekazu Enoki, Kanagawa (JP); Kumiko Hatakeyama, Kanagawa (JP); Koichi Kato, Kanagawa (JP); Toshiyuki Kabata, Kanagawa (JP); Jun Yura, Kanagawa (JP) --

Signed and Sealed this

Twenty-ninth Day of April, 2008

JON W. DUDAS
*Director of the United States Patent and Trademark Office*